US008011119B2

(12) United States Patent
Tvoua et al.

(10) Patent No.: US 8,011,119 B2
(45) **Date of Patent: *Sep. 6, 2011**

(54) PERSONALLY ADJUSTABLE FOOTWEAR

(75) Inventors: Ofer Tvoua, Rishon Lezion (IL); Amir Tvoua, Rishon Lezion (IL); Offer Canfi, Lehavim (IL)

(73) Assignee: Peeerfect Fit LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/492,553

(22) Filed: Jun. 26, 2009

(65) Prior Publication Data

US 2009/0307929 A1 Dec. 17, 2009

Related U.S. Application Data

(63) Continuation of application No. 10/561,429, filed as application No. PCT/IL2005/001117 on Oct. 26, 2005, now Pat. No. 7,565,755.

(30) Foreign Application Priority Data

Oct. 27, 2004 (IL) ..... 164853

(51) Int. Cl.
*A43B 3/26* (2006.01)

(52) U.S. Cl. ..... 36/97; 36/11.5

(58) Field of Classification Search ..... 36/97, 7.1 R, 36/7.5, 7.6, 7.7, 100, 11.5, 102
See application file for complete search history.

(56) References Cited

U.S. PATENT DOCUMENTS 1,633,413 A * 6/1927 La Marca ..... 36/91
2,009,684 A * 7/1935 Affronte ..... 36/97
2,112,052 A * 3/1938 Smith ..... 36/97
2,497,175 A * 2/1950 Mantos ..... 36/97
2,523,449 A * 9/1950 Rosenzweig ..... 36/97
2,952,925 A * 9/1960 Held ..... 36/97
3,389,481 A * 6/1968 England ..... 36/97
3,436,842 A * 4/1969 Sachs ..... 36/97
3,997,985 A * 12/1976 Shiina ..... 36/97
4,114,296 A * 9/1978 Smith ..... 36/101
4,120,103 A * 10/1978 Colby ..... 36/97
4,290,211 A * 9/1981 Csengeri ..... 36/3 B
4,727,662 A * 3/1988 Ilon ..... 36/132
5,265,349 A * 11/1993 Munschy ..... 36/97
5,570,523 A * 11/1996 Lin ..... 36/112
5,659,980 A * 8/1997 Lin ..... 36/112
5,666,746 A * 9/1997 Pollard ..... 36/135
5,682,687 A * 11/1997 Arai ..... 36/97
5,966,840 A * 10/1999 Bell et al. ..... 36/7.6
6,138,385 A * 10/2000 Jungkind et al. ..... 36/97
6,237,255 B1 * 5/2001 Renaudin et al. ..... 36/97
6,438,872 B1 * 8/2002 Chil et al. ..... 36/97
6,574,888 B2 * 6/2003 Miller et al. ..... 36/97

(Continued)

*Primary Examiner* — Marie Patterson

(74) *Attorney, Agent, or Firm* — Hedman & Costigan, P.C.; James V. Costigan

(57) ABSTRACT

Personally adjustable footwear with at least one sole layer including: a toe portion, a heel portion, and an intermediate portion. The intermediate portion has openings passing vertically through the layer so that the intermediate portion is elastically flexible to allow relative longitudinal displacement of the toe portion and the heel portion to vary a length of the layer without significant variation in a thickness of the layer. A retention mechanism selectively fixes the toe and heel portions in any of a number of relative positions. Also disclosed are implementations with insertable and removable segments, and with elongated elements sliding in channels.

20 Claims, 16 Drawing Sheets

U.S. PATENT DOCUMENTS

| | | | | |
|---|---|---|---|---|
| 6,742,286 | B2 * | 6/2004 | Giovale | 36/7.6 |
| 7,565,755 | B2 * | 7/2009 | Tvoua et al. | 36/97 |
| 2005/0050772 | A1 * | 3/2005 | Miller et al. | 36/97 |
| 2005/0055849 | A1 * | 3/2005 | Ha | 36/97 |
| 2005/0060913 | A1 * | 3/2005 | Chil et al. | 36/97 |
| 2005/0115114 | A1 * | 6/2005 | Miller et al. | 36/97 |
| 2006/0130371 | A1 * | 6/2006 | Schneider | 36/97 |
| 2007/0011916 | A1 * | 1/2007 | Olivieri | 36/97 |

* cited by examiner

PERSONALLY ADJUSTABLE FOOTWEAR

REFERENCE TO RELATED APPLICATIONS

The present application is a continuation of U.S. patent application Ser. No. 10/561,429 filed on Dec. 19, 2005, now U.S. Pat. No. 7,565,755, now allowed, a §371 Application of PCT/IL05/01117, filed Oct. 26, 2005, which is based on Israeli Application No. 164853 filed on Oct. 27, 2004. The parent application is also the parent to U.S. patent application Ser. No. 29/271,550, now U.S. Pa. No. D560,882, U.S. patent application Ser. No. 29/293,499, now U. S. Pat. No. D584, 884, U.S. patent application Ser. No. 29/307,037, now U.S. Pat. No. D595,485 and U.S. patent application Ser. No. 29/338,947 filed Mar. 28, 2009.

FIELD AND BACKGROUND OF THE INVENTION

This invention relates to footwear, particularly footwear whose size is adjustable.

The term "footwear" when used herein, is to be taken in its broadest sense and denotes shoes, sneakers, sandals, clogs, boots, skates, sportswear for the foot, etc.; and any of these terms may be substituted herein for the term "footwear".

There is known in the art shoes whose longitudinal dimension is adjustable by a variety of ways.

U.S. Pat. No. 524,946 (Kregel) discloses a shoe intended for fitting to a deceased person for viewing and interment. Adjustability is achieved using an elastic band extending between a heel portion and toe portion designed to draw the heel portion forward to snuggly fit to the foot of the deceased.

U.S. Pat. No. 641,642 (Gunn) discloses a shoe, being adjustable length-wise and width-wise, the sole of which comprises a frame part at the shoe's heel and a shank at the middle/front of the sole. The frame part and shank are slidable with respect to one another to the extent of a slot in the shank. Upon adjusting to a desired length, the length of the sole is fixed by tightening a screw. The shoe comprises an upper, or top portion, designed to accommodate inserts on the right and left sides thereof, which can be folded to allow adjustment of the top portion of the shoe. The insert is secured by a lacing cord which passes between two vertical rows of eyelets. A similar arrangement is used to adjust the width of the shoe, with laterally arranged slots.

U.S. Pat. No. 2,009,684 (Affronte) describes a shoe, having a similar length adjusting means wherein the shank has a tongue being slidable within a receiving portion of the heel section of the sole. The tongue has a plurality of holes for allowing a screw to pass and fix the tongue to the heel section at a hole corresponding to the desired shoe length.

U.S. Pat. No. 2,497,175 (Mantos) provides a shoe formed of two main sections designed to be joined together by workmen in the shop of a shoe dealer whereby the size of the shoe can be adjusted to a given size prior to completing assembly of the shoe. A metal shank projecting from the toe section of the sole comprises an integral fork aligned with a metal sheath or plate mounted in the heel portion of the sole. The fork has tines with triangularly shaped lugs along their edges corresponding to receiving members on the sheath to allow the toe and heel sections of the shoe to be securely attached to produce a shoe having any number of discrete lengths.

U.S. Pat. No. 3,389,481 (England) shows an expandable shoe having a mid-section of bellows-like material permitting longitudinal expansion and contraction along a sliding guide having a locking mechanism to secure the fit at a desired length. The locking mechanism comprises a metal shank having two sliding plates, one of which has a transverse slot for receiving a detent formed in the other plate. A screw assembly extending up though the heel is removed to allow the plates to slidable over one another, and then it is reinserted to retain the shoe in the newly extended position.

U.S. Pat. No. 3,997,985 (Shina) discloses a stretchable shoe, particularly suitable for a growing child, comprising a front member and a rear member which may be adjusted in length. The front member and the rear member are separable and inter-connected by a screw which passes through one hole of the front member and one of a plurality of holes of the rear member. The front member is composed of an upper, an insole, a middle plate and a bottom plate, and the rear member is composed of a sole, an upper and a heel.

U.S. Pat. No. 5,659,980 (Lin) discloses an adjustable shoe which has a heel, a toecap and an insole. The front portion of an instep has a plurality of positioning protrusions. First and second fastening pads are disposed on two outer sides of the heel. First and second ball buttons are disposed on the rear surface of the heel. An adjustable pad with positioning holes therein is disposed on the toecap from which two flaps extend. The inner surface of the flap has a fastening element. The first and second positioning plates are extended from the back of the outsole. The first positioning plate holds the first socket button and the second positioning plate holds the second socket button.

U.S. Pat. No. 6,138,385 (Jungkind) describes a shoe sole having a jointed middle section located between toe and heel portions of the sole. The middle section is made of an elastically flexible of springy material configured as a wavy or folded web with crests and troughs. A spindle runs from the heel to the toe portions and has a head located inboard of the rear edge of the heel portion. The spindle is rotatable/screwable into a nut whereby the shoe can be adjusted in length.

It would therefore be advantageous to provide footwear whose size can be adjusted by the wearer. It would also be advantageous to provide such adjustable footwear which is personalizable and easily and quickly re-adjustable.

SUMMARY OF THE INVENTION

The present invention relates to footwear whose size can be conveniently and easily adjusted without any need for tools.

Such footwear typically comprises a toe portion (hereinafter "toe"), a heel portion (hereinafter "heel"), composing a sole and may also include a top portion or so-called upper.

According to the teachings of the present invention there is provided, personally adjustable footwear comprising: (a) at least one sole layer including: a toe portion, a heel portion, and an intermediate portion, the intermediate portion being integrally formed with both the toe portion and the heel portion, the intermediate portion having a plurality of openings passing substantially vertically through the layer so that the intermediate portion is elastically flexible to allow relative longitudinal displacement of the toe portion and the heel portion to vary a length of the layer without significant variation in a thickness of the layer; and (b) a retention mechanism associated with both the toe portion and the heel portion, the retention mechanism being configured for retaining any of a plurality of relative positions between the toe portion and the heel portion.

According to a further feature of the present invention, the toe portion, the heel portion and the intermediate portion are all integrally formed from a uniform composition.

According to a further feature of the present invention, the plurality of openings are deployed to provide a latticework pattern as viewed from above.

According to a further feature of the present invention, the at least one sole layer has an upper surface providing a foot support, wherein the plurality of openings are configured to have a maximum open longitudinal dimension no greater than about 2.5 centimeters so as to provide near-continuous foot support.

According to a further feature of the present invention, the at least one sole layer is implemented as at least two sole layers including a lower sole layer having a bottom surface configured for ground engagement and an upper sole layer including an upper surface for supporting a foot.

According to a further feature of the present invention, the upper sole layer is formed from a material softer than the lower sole layer.

According to a further feature of the present invention, the lower sole layer and the upper sole layer are shaped to define therebetween at least one longitudinal channel extending longitudinally between the toe portions and the heel portions, and wherein the retention mechanism includes an element deployed within the channel, the element being anchored to a first of the toe portion and the heel portion and being displaceable relative to the second of the toe portion and the heel portion.

According to a further feature of the present invention, wherein the sole layer forms at least part of a sole arrangement, the sole arrangement including at least one longitudinal channel extending longitudinally between the toe portion and the heel portion, and wherein the retention mechanism includes an element deployed within the channel, the element being anchored to a first of the toe portion and the heel portion and being displaceable relative to the second of the toe portion and the heel portion.

According to a further feature of the present invention, the retention mechanism further includes a stepped resistance arrangement associated with the element and the second of the toe portion and the heel portion, the stepped resistance arrangement providing a resistive force opposing relative displacement of the toe portion and the heel portion between a plurality of predefined relative positions corresponding to a plurality of different lengths of the sole arrangement, such that a length of the sole arrangement is manually adjustable by manual application of force to overcome the resistive force, and such that, in the absence of manually applied force, the toe portion and the heel portion are retained in one of the predefined relative positions.

According to a further feature of the present invention, the intermediate portion is resiliently biased to separate the toe portion and the heel portion to a predefined relative position corresponding to a maximum length of the sole arrangement, and wherein the retention mechanism further includes: (a) a flexible strap associated with the element and extending from the sole arrangement such that tension applied to the flexible strap relative to the second of the toe and the heel portions draws together the toe portion and the heel portion, thereby shortening the length of the sole arrangement; and (b) a locking arrangement for locking the flexible strap in a plurality of positions, thereby retaining the sole arrangement at a desired length.

According to a further feature of the present invention, the locking arrangement includes a first part of a hook-and-loop fastener associated with an end portion of the flexible strap and a complementary part of a hook-and-loop fastener associated with an upward-facing surface of the sole arrangement such that the flexible strap is folded onto the upward-facing surface to lock the sole arrangement at a desired length.

According to a further feature of the present invention, the retention mechanism further includes a manually releasable and manually engagable locking mechanism for locking a position of the element relative to the second of the toe portion and the heel portion.

According to a further feature of the present invention, the retention mechanism includes a manually releasable and manually engagable locking mechanism for locking a relative position of the toe portion and the heel portion.

According to one embodiment of the invention, the footwear comprises a series of sole segments (laterally oriented, longitudinally oriented, or a combination thereof) disposed between the toe and the heel. These segments can be added or removed to adjust the size of the footwear; or, they may be spaced further apart or closer together to adjust the footwear size.

Each of the segments comprises an arrangement allowing them to be fixed between the toe and heel. One option for such an arrangement is by having at least one, and typically two or more, parallel bores which are oriented to run longitudinally to the footwear while extending from the toe toward and into the heel, or vice versa, there are one or more segment holding members (e.g. rod-like members, cables, tongue-like member (s), etc.) adapted to be aligned with the bores of the segments and with corresponding bores in the heel (or toe, if vice versa). The segment holding members may be fairly rigid, however with appropriate resiliency/flexibility to allow for suitable movement when the footwear is being worn; however, they may be stretchable, for example, rubber band-like members. Depending upon the option, the heel or toe may comprise a locking mechanism, which would be appropriate, for example, to an embodiment comprising rod-like members extending between the toe and heel.

Segments adapted for this option are typically in the shape of a bar with a square profile, however, they may be of any of a variety of shapes, styles, colors, shapes, etc., and include aesthetic ornamental or artistic features so that the wearer can modify the style of the footwear to his or her taste—as may segments usable in other options, described below.

Another option for fixing segments between the toe and heel is by their being adapted to inter-engage or inter-connect with each other and to engage with the toe and heel. Inter-engaging may be by a variety of arrangements, including "Lego™-type" connections, snap-fitting, screw-fitting, twist-fitting, hooking, hook and loop fasteners (Velcro™), etc.

According to another embodiment of the invention, the footwear comprises toe and heel portions connected therebetween by a bellows-like structure, constituting a middle section, being compressible and/or expandable at least in the direction longitudinal to the footwear.

Projecting from the toe is a tongue that extends into a corresponding tongue receptacle in the heel, or vice versa. The tongue comprises a plurality of linearly arranged holes passing therethrough and alignable with corresponding to holes in the tongue receptacle. The heel comprises a top portion which can be bent upward and having a plurality of downward projections or pegs adapted to pass through the holes of the tongue and into the bores/depressions of the tongue receptacle. The size of the footwear can be adjusted by lifting the top portion and sliding the toe and the heel toward each other, or apart, until a size, corresponding to an alignment of the holes of the tongue and tongue receptacle is achieved. The top portion is then lowered to fix the length.

Optionally, the footwear can include an arrangement for facilitating alignment of the pegs and corresponding bores. Further, the tongue may comprise an indicator to point to indicia adjacent the tongue receptacle which indicates the size of the shoe at a given adjustment portion.

According to an additional embodiment of the present invention, the footwear's toe and heel each comprise members (e.g. finger-like members, typically in a male/female connection) which extend toward and engage with each other. The members are slidable with respect to each another to allow for different footwear length, and typically have profiles shaped in such a way as to prevent vertical displacement.

At a desired length, a tongue with at least one extending peg/projection can be inserted into a tongue receptacle at the heel.

Thus, the present invention provides footwear whose size can be conveniently and easily adjusted without any need for tools, possibly by a wearer thereof. The footwear according to embodiments of the invention is readjustable, thus it can be adjusted to a variety of lengths at any time.

BRIEF DESCRIPTION OF THE DRAWINGS

In order to understand the invention and to see how it may be carried out in practice, embodiments will now be described, by way of non-limiting examples only, with reference to the accompanying drawings, in which.

DESCRIPTION OF THE PREFERRED EMBODIMENTS

Figure 1:
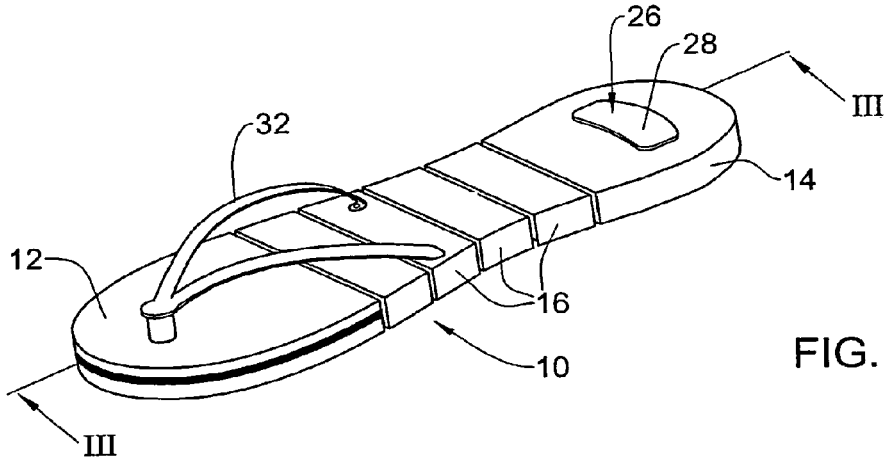
FIG. 1 is a perspective view of an embodiment of adjustable footwear according to the present invention.
Figure 2:
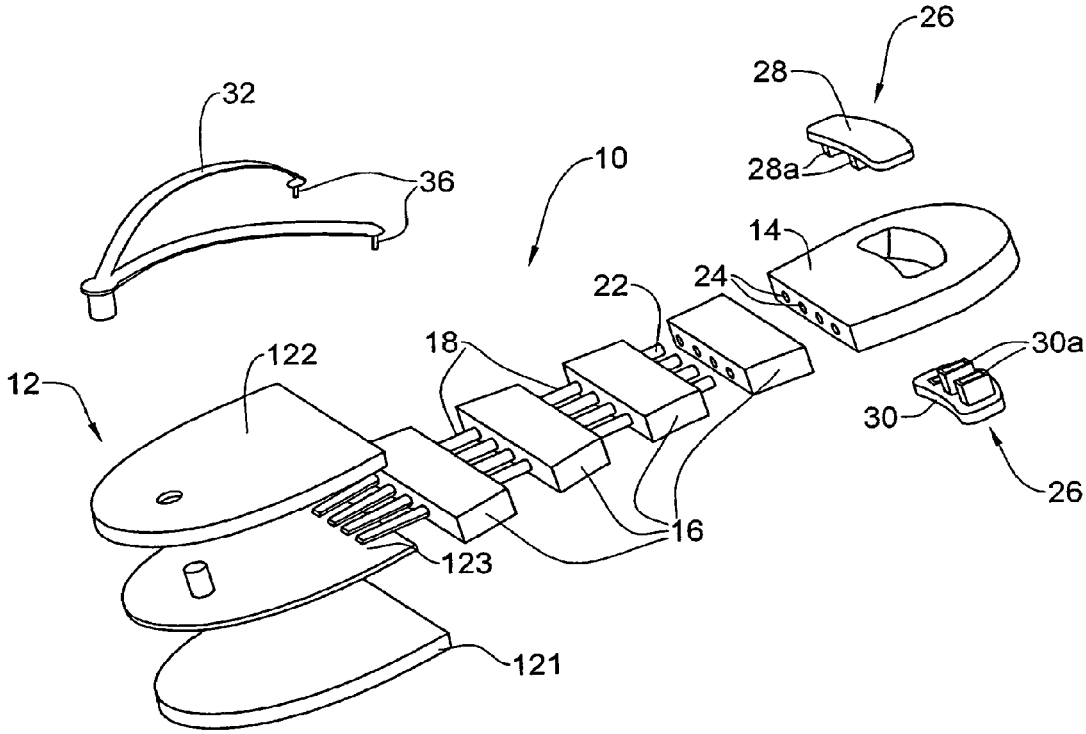
FIG. 2 is an exploded view of the embodiment shown in FIG. 1.
Figure 3A:
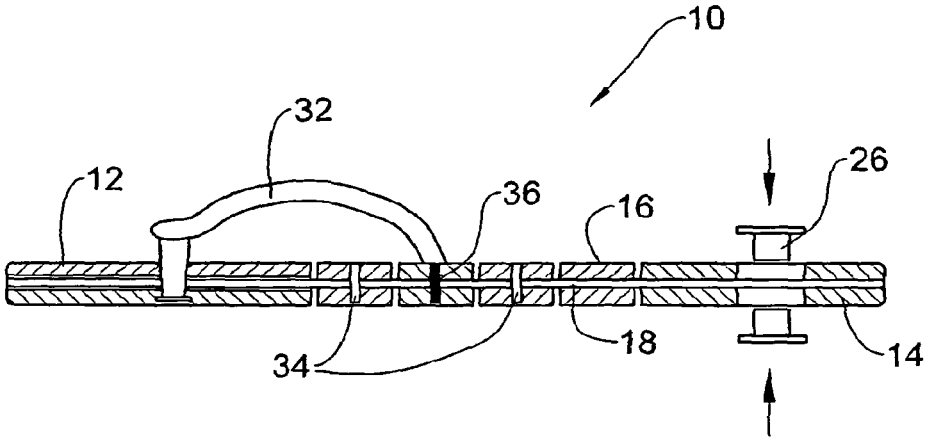
FIG. 3A is a longitudinal sectional view along line III-III in FIG. 1.
Figure 3B:
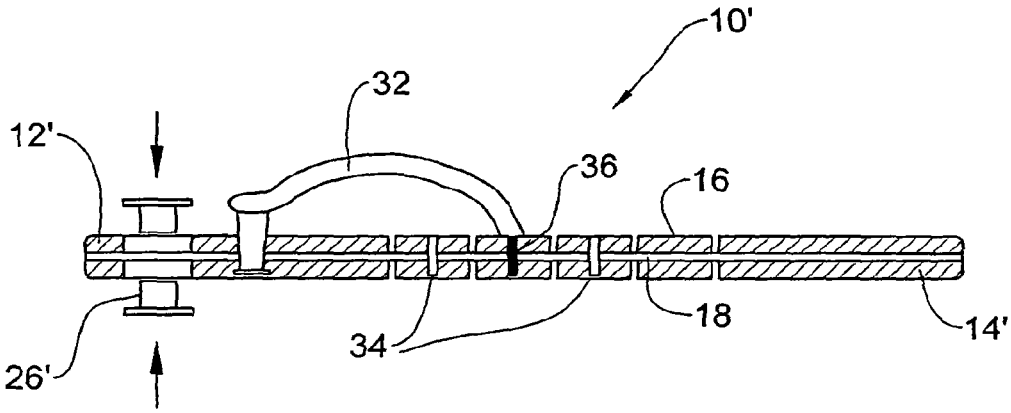
FIG. 3B is a sectional side view of a modification of the embodiment of FIGS. 1-3.

Referring to FIGS. 1-5, a first embodiment, including particular modifications, of an article of footwear, generally designated as 10, of the present invention, is illustrated. The footwear 10 comprises a toe portion 12 (hereinafter "toe") and a heel portion 14 (hereinafter "heel") and a plurality of segments 16 disposed therebetween. Extending from the toe 12 toward the heel 14 is at least one (and typically more than one) segment holding member in the form of a rod-like member—for example, four rods 18 as illustrated in FIG. 2.

The segments 16 typically have a geometry wherein they have a length and a width, the length being longer than the width—in other words an aspect ratio greater than one. The segments 16 may comprise an indication of their size, in particular the dimension affecting the length of the footwear 10. Such an indication may be a numeral thereon indicating its dimension, or a color, shape, decoration, etc., corresponding to a dimension. However, the segments 16 may be of various shapes, colors, etc., merely for decorative purposes. The segments 16 may also be made of different materials for functional (e.g. wear-strength, comfort) and/or decorative purposes.

The segments 16 have essentially horizontal holes or bores 20 (best seen in FIG. 4) adapted so that the rods 18 can pass therethrough. For this purpose, at least some of the segment's bores 20 are alignable with each other. In this manner, the segments 16, which constitute a middle portion of the sole of the footwear, can be incorporated into the sole or removed therefrom whereby the size of the footwear 10 is adjustable.

The heel 14 also has holes or bores 24 being alignable with the rods 18 and thus alignable with at least some of the bores 20 in the segments 16. The heel's bores 24 are adapted to receive the rods 18 (i.e. free ends 22 thereof). The rods 18 extend into the heel 14 where they are fixed in place by a locking mechanism 26.

The locking mechanism 26 comprises, for example, a top portion 28 and a bottom portion 30, at least one or the other of the portions adapted to hold or clamp the rods 18 in place. Typically, the portions 28 and 30 are designed to be engageable with each other, in any known manner. For this purpose, the portions 28 and 30 may have engagement members 28*a* and 30*a*, respectively.

In order to adjust the size of the footwear 10, the locking mechanism 26 is disengaged allowing the heel 14 to be slid back away from the toe 12 whereby it is removed from the rods 18. Then, segments 16 are added or removed to increase or decrease the length of the footwear 10. The heel 14 is then replaced, and then the locking mechanism 16 is reaffixed.

To further accommodate such adjustment, if the footwear 10 is a sandal or "flip-flop" or "thong" type, wherein it typically incorporates a toe-strap 32, the positioning of said toe-strap 32 may be altered. For this purpose, at least some of the segments 16 may further comprise (essentially) vertical bores 34 (FIGS. 3A, 3B and 4) adapted to receive attachment projections 36 of the toe-strap 32 which can be attached (fixed in place) by any known means.

As understood from the exploded view of the footwear 10 in FIG. 2, the toe 12 can be composed of layers, for example an outsole layer 121, an insole layer 122 and an intermediate layer 123. Such a design may be convenient for manufacturing and allow for portions/layers of different characteristics. For example, the outsole layer 121 may be made of a wear resistant material for increasing the life of the footwear 10 and the insole layer 122 may be made of a relatively soft or compliant material for comfort of a wearer.

Figure 4:
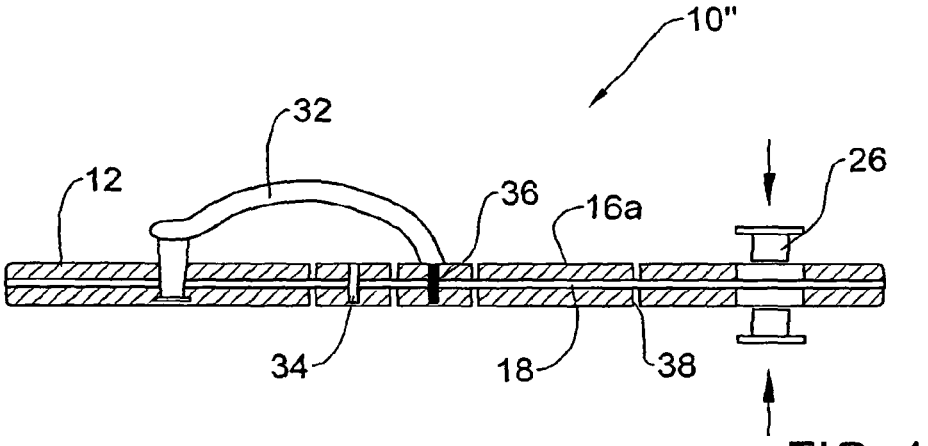
FIG. 4 is a longitudinal sectional view showing another modification to the embodiment shown in FIG. 1.

FIG. 4 illustrates an article of footwear 10" being a modification of that described with reference to the preceding figures. Here, the footwear 10" comprises at least some segments 16*a* having at least one transverse bore 38; best seen in FIG. 5A. A segment 16*b* shown in FIG. 5A illustrates the possibility of the segment having both bores like bores 20 and like bore 38; thereby providing different options for achieving a given footwear length as well as a particular aesthetic aspect (e.g. different colors on each face of the segment) or flexibility thereto.

Figure 5A:
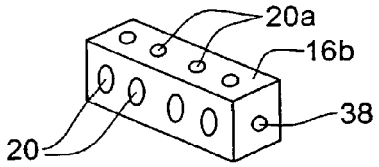
FIG. 5A is a perspective view of a segment usable in any of the embodiments of FIGS. 1-4.

Additionally, the segments 16*b* could include bores 20*a* essentially perpendicular to bores 20 such that the segment could be incorporated in the footwear 10 rotated a quarter turn/rotation to that shown in FIG. 5A. This feature could have advantages in situations, for example, where any of the segments 16*b* have designs thereon or are shaped in a way that the overall design of the footwear can be changed (by turning/rotating segments), thereby giving the wearer the option to "self-design" the footwear to his/her taste. Bore 38 also provides flexibility in this regard.

It should be understood that the heel 14 could be designed in a manner analogous to that just described with respect to the toe 12, and vice versa. In other words, referring now to FIG. 3B, there may be footwear 10' of the present invention wherein the rods 18 extend from a heel 14' toward a toe 12' and being locked in place by a locking mechanism 26' at the toe 12', mutatis mutandis.

It should also be noted that rather then providing several extension segments 16, there may be provided one or more segments, the length of which may be predetermined or be set to suit an individual's foot size, e.g. by trimming the length of such segments.

FIGS. 5B-5I illustrate various examples of segments which may be used in adjustable footwear according to further embodiments of the present invention. The segments shown in these figures do not require a segment holding member (rod, tongue, cable, elastic, etc.) rather instead they comprise inter-engaging or inter-corresponding members, typically male-female type engagement elements.

Figure 5B:
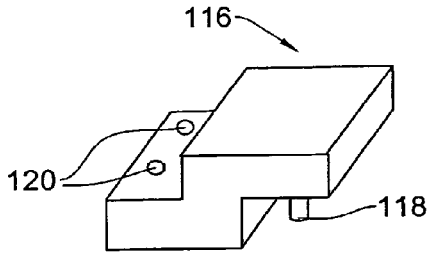
FIGS. 5B-5J are perspective views of segments for use in further embodiments of adjustable footwear of the present invention.

In FIG. 5B there is shown a segment 116 having a "Lego™-type" configuration. Thus, it has projections 118 (only one is seen) and indentations 120 which are designed to correspond to indentations and projections of other similarly configured segments. Naturally, a toe and heel of footwear used in an embodiment shown in FIG. 5B would also have corresponding projections or indentations, as the case may be, so that the segments 116 could be suitably joined thereto. It should be understood that this latter situation is the same for all of the segments described in FIGS. 5B-5I, and therefore this fact shall not be repeated.

Figure 5C:
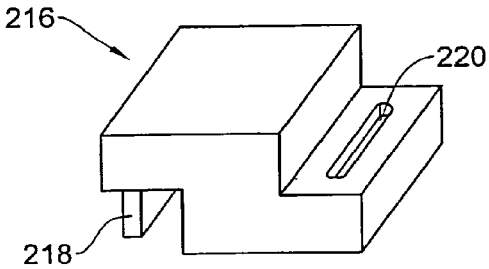

In FIG. 5C there is shown a segment 216 being similar to segment 116 of FIG. 5B, however it comprises an elongated projection 218 and a slotted indentation 220—again, designed to correspond to an indentation and projection of other similarly configured segments.

Figure 5D:
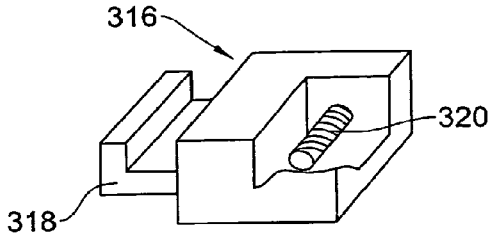

In FIG. 5D there is shown a segment 316 comprising a wide hook-shaped projection 318 and a rod 320. For illustration purposes, the segment 316 is shown with a partial cutaway in the area of the rod 320 and typically the rod 320 would be attached to the rest of the segment at both its ends to provide strong support. To join such segments 316 with each other, one segment is angled to allow the hook-shaped projection 318 to be slid under the slotted indentation 320 of another segment, and then it is arranged to be flush to that other segment.

Figure 5E:
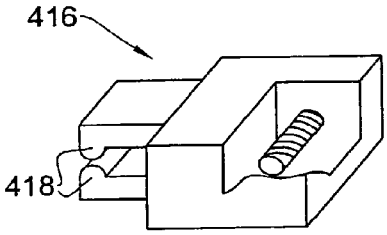

FIG. 5E presents a segment 416 being similar to segment 316 of FIG. 5D, however it comprises a pair of resilient projections 418 that can inter-engage with a rod 420. Again, for illustration purposes, the segment 416 is shown with a partial cutaway in the area of rod 420. To join such segments 416 with each other, one segment is pushed toward another segment causing the projections 418 to first open when nubs 422 of the projections 418 contact the rod 420 of another segment, and then to close around the backside of the rod 420 in a snap-fit manner.

Figure 5F:
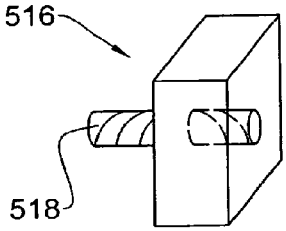

FIG. 5F shows another segment 516 connectable to like segments; as above. Here, the segment 516 comprises a screw-like projection 518 that can inter-engage with a threaded indentation 520. To join such segments 516 with each other, one segment is simply turned so that its screw-like projection 518 screws into the threaded indentation 520 of another segment.

Figure 5G:
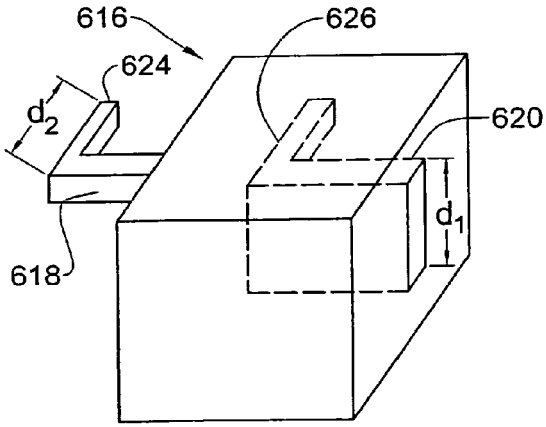

FIG. 5G shows yet another example of a segment 616 connectable to like segments. Here, the segment 616 comprises a projection, for example an L-shaped projection 618 that can inter-engage with a corresponding indentation 620. The indentation 620 comprises a slot 622 and the projection comprises an arm 624, the slot having a length dimension d1 typically being a bit longer than a length dimension d2 of the arm 624 of the L-shaped projection 618.

To join such segments 616 with each other, a first segment is turned 90° so that its L-shaped projection 618 fits into the slot 622 of the other segment, then the first segment is pushed flush to the other segment, and lastly it is turned 90° so that the arm 624 enters an arm-receiving cavity 626 of the indentation 620.

Figure 5H:
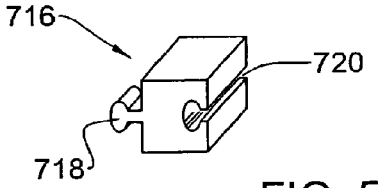

FIG. 5H shows yet a further example of a segment 716 connectable to like segments. Here, the segment 716 is a puzzle-like piece and comprises a projection 718 adapted to fit into an indentation 720 by either sliding transversely or by a pressure/snap fitting method.

Figure 5I:
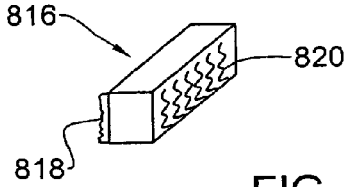

FIG. 5I provides an embodiment showing another example wherein segments are inter-connected. Here, segments 816 (only one shown) have hook and loop fasteners (Velcro™) 818 and 820 adhered to their sides whereby they can attach one to the next.

Figure 5J:
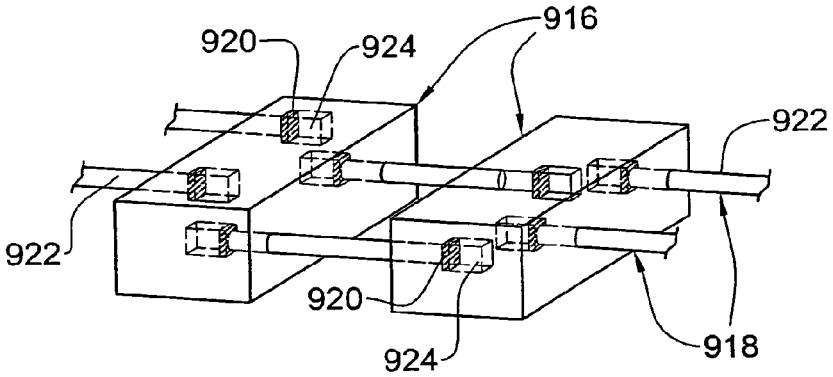

FIG. 5J illustrates another embodiment wherein segments are inter-connected. However, in this case there are segments 916 that remain connected while being movable in relation to each other in that they can be spaced apart, to various degrees, or be positioned adjacent each other. This option can be accomplished, for example, as seen in FIG. 5I.

The segments 916 have segment connecting members 918, for example nail-shaped members having a head 920 and a stem 922. The segments 916 comprise cavities 924 (shown with dashed lines) within which the heads 920 and a portion of the stems 922 are located; these also being shown with dashed lines where they are internal to the segments 916. The cavities 924 are shaped such that the connecting members 918 can be slid back and forth whereby the segments 916 may be positioned closer or farther from each other.

To fix the distance, the cavities 924 are adapted to fairly snugly hold the connecting members 918, or the segments 916 may be held in place by one of several alternate methods (e.g. such as described below).

Figure 6:
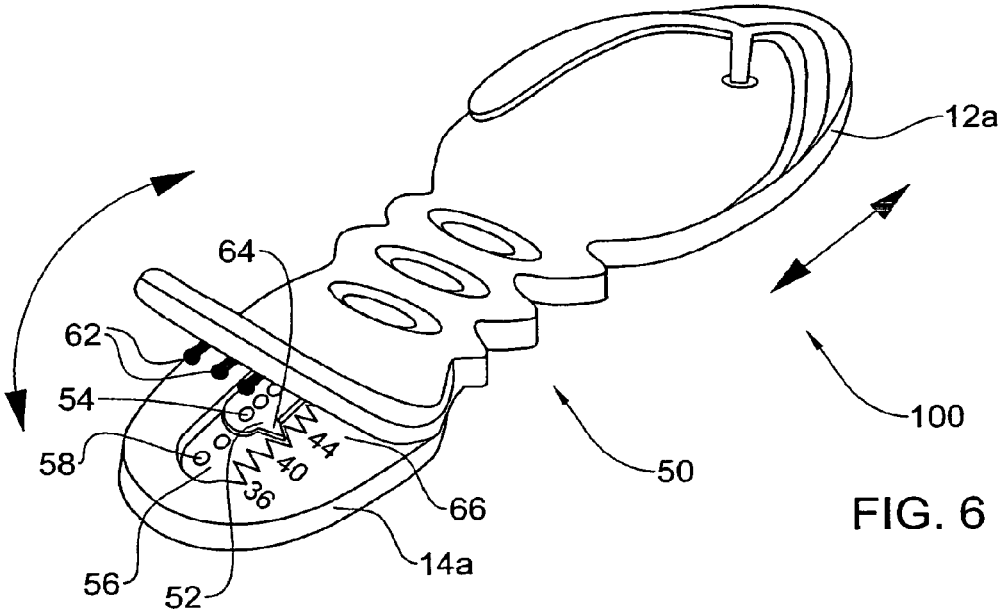
FIG. 6 is a perspective view of another embodiment of the present invention.
Figure 7:
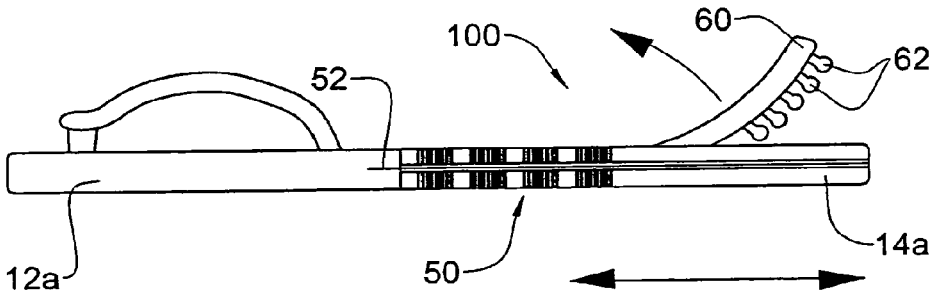
FIG. 7 is a longitudinal sectional view of the embodiment shown in FIG. 6.

FIGS. 6 and 7 illustrate another embodiment of the present invention, providing an article of footwear, generally designated as 100. Here, disposed between a toe 12*a* and a heel 14*a* is a flexible bellows-like intermediate portion 50 which connects the toe and heel and provides size flexibility to the footwear 100. More specifically, as illustrated in FIGS. 6 and 7, footwear 100 includes at least one sole layer including: toe portion 12*a*, heel portion 14*a*, and intermediate portion 50, the intermediate portion being integrally formed with both the toe portion and the heel portion, preferably from a uniform composition. It is a particularly preferred feature of this embodiment, and of the variants of this embodiment described below, that intermediate portion 50 features a plurality of openings passing substantially vertically through the sole layer so that intermediate portion 50 is elastically flexible to allow relative longitudinal displacement of the toe portion and the heel portion to vary a length of the layer without significant variation in a thickness of the layer. In this context, the term "vertically" is used to refer to a direction generally perpendicular to the ground-engaging surface and/or foot supporting surface of the footwear.

Footwear 100 also features a retention mechanism associated with both toe portion 12*a* and heel portion 14*a* and configured for retaining any of a plurality of relative positions between the toe portion and the heel portion. Preferably, the sole arrangement includes at least one longitudinal channel (also referred to as a "passage") extending longitudinally between the toe portion and the heel portion, and the retention mechanism includes an element (in this case, a tongue 52) deployed within the channel. The element is anchored to either toe portion 12*a* or heel portion 14*a* and is displaceable relative to the other portion (heel portion 14*a* or toe portion 12*a*, respectively).

Thus, in the example illustrated in FIGS. 6 and 7, the toe 12*a* has a tongue 52, which may be integral therewith or attached thereto, adapted to be slidable through a passage (not seen) in the intermediate portion 50. The tongue 52 comprises a plurality of through-holes 54 being collinear and typically equally spaced apart. The heel 14*a* comprises a tongue receptacle 56 having depressions 58 corresponding, and similarly spaced, to holes 54.

The heel 14*a* comprises a top portion 60 adapted to be upwardly bendable, exposing the tongue receptacle 56. The top portion 60 includes at least one downwardly projecting peg-like member 62, arranged, and of a size, to pass through the tongue's holes 54 and be engagedly receivable in the depressions 58 of the tongue receptacle 56, for example, in a snap-fit type manner.

To adjust the size of the footwear 100, the heel's top portion 60 is lifted (illustrated by dashed lines in FIG. 7), thereby decoupling the peg-like members 62 from the depressions 58 and lifting them out from the holes 54. The toe 12*a* and the heel 14*a* are then slid toward or away from each other to respectively decrease or increase the length of the footwear 100. This may entail compressing or expanding the intermediate portion 50 for which purpose it is made of a flexible, resilient material.

When a desired length is achieved, within the tolerance of the distance between the spaced-apart holes 54, the size of the footwear 10 can be fixed. This is accomplished by aligning the tongue's holes 54 with the tongue receptacle depressions 58 and closing the heel's top portion 60 downward to recouple the peg-like members 62 with the depressions 28.

Optionally, there may be provided a marker 64, such as an arrow or projection, associated with the tongue 52, along with indicia 66 adjacent the tongue receptacle 56, for indicating a shoe size. This marker/indicia arrangement may also be useful for making it easier to align the tongue's holes 54 with tongue receptacle's depressions 58; for example, by means of a projection/socket. (male/female component) arrangement for ensuring alignment.

It should be understood that the function provided by the heel's top portion 60 could alternatively be provided by a bottom portion thereof or even by a top or bottom portion of the toe 12*a*, mutatis mutandis.

Turning now to FIGS. 13A-18, these illustrate a number of variant implementations based upon the concept of footwear 100, and more specifically, wherein a sole arrangement includes at least one layer formed with a flexible intermediate portion for allowing elongation and contraction of a length of the sole arrangement. These variant implementations differ from footwear 100 described above primarily in: (a) the shape of the vertical openings through the layers used to impart flexibility to the intermediate portion; and (b) the implementations of the retention mechanism.

Figure 13A:
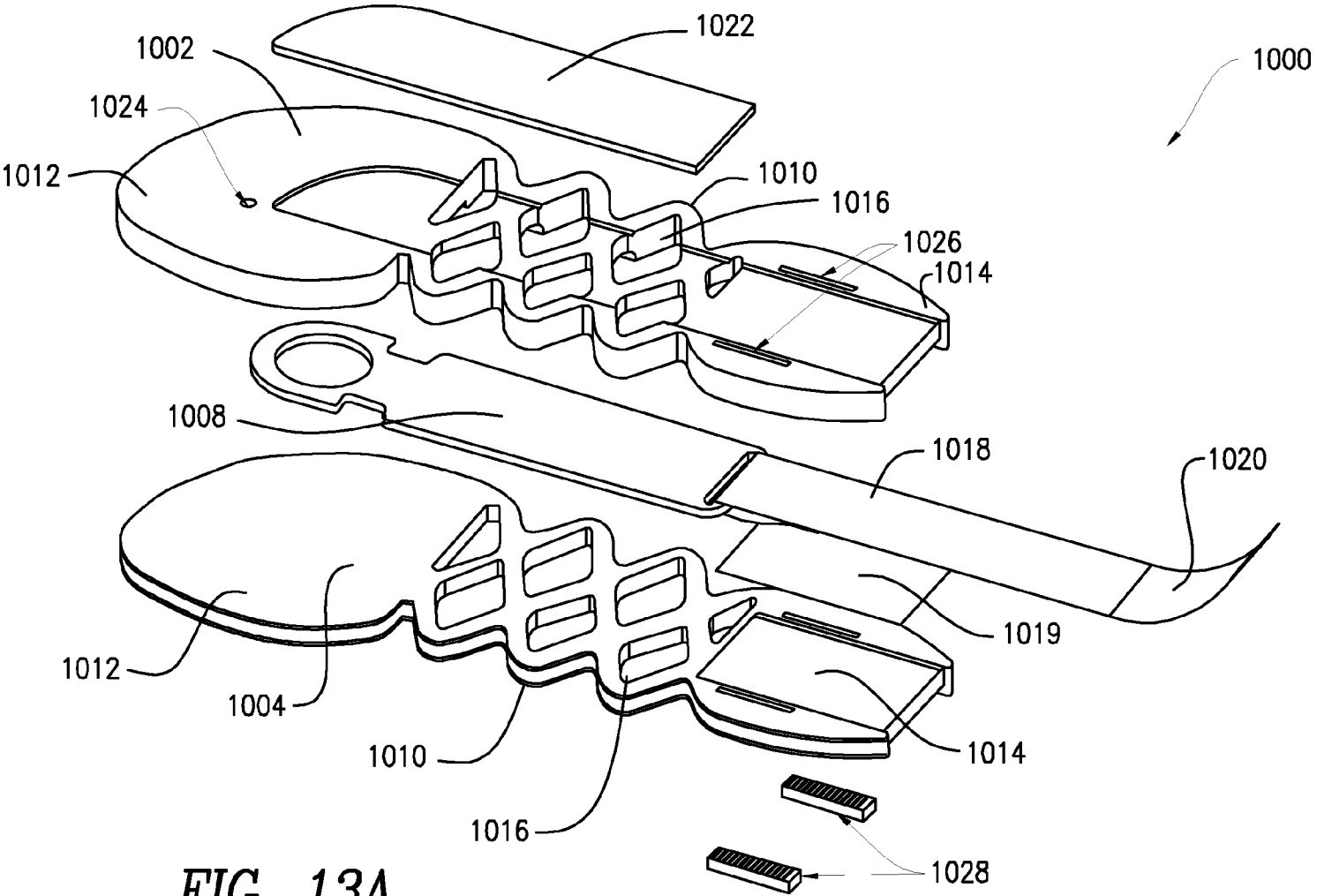
FIGS. 13A and 13B are upper and lower exploded isometric views, respectively, of a first variant of the embodiment of FIGS. 6 and 7.
Figure 13B:
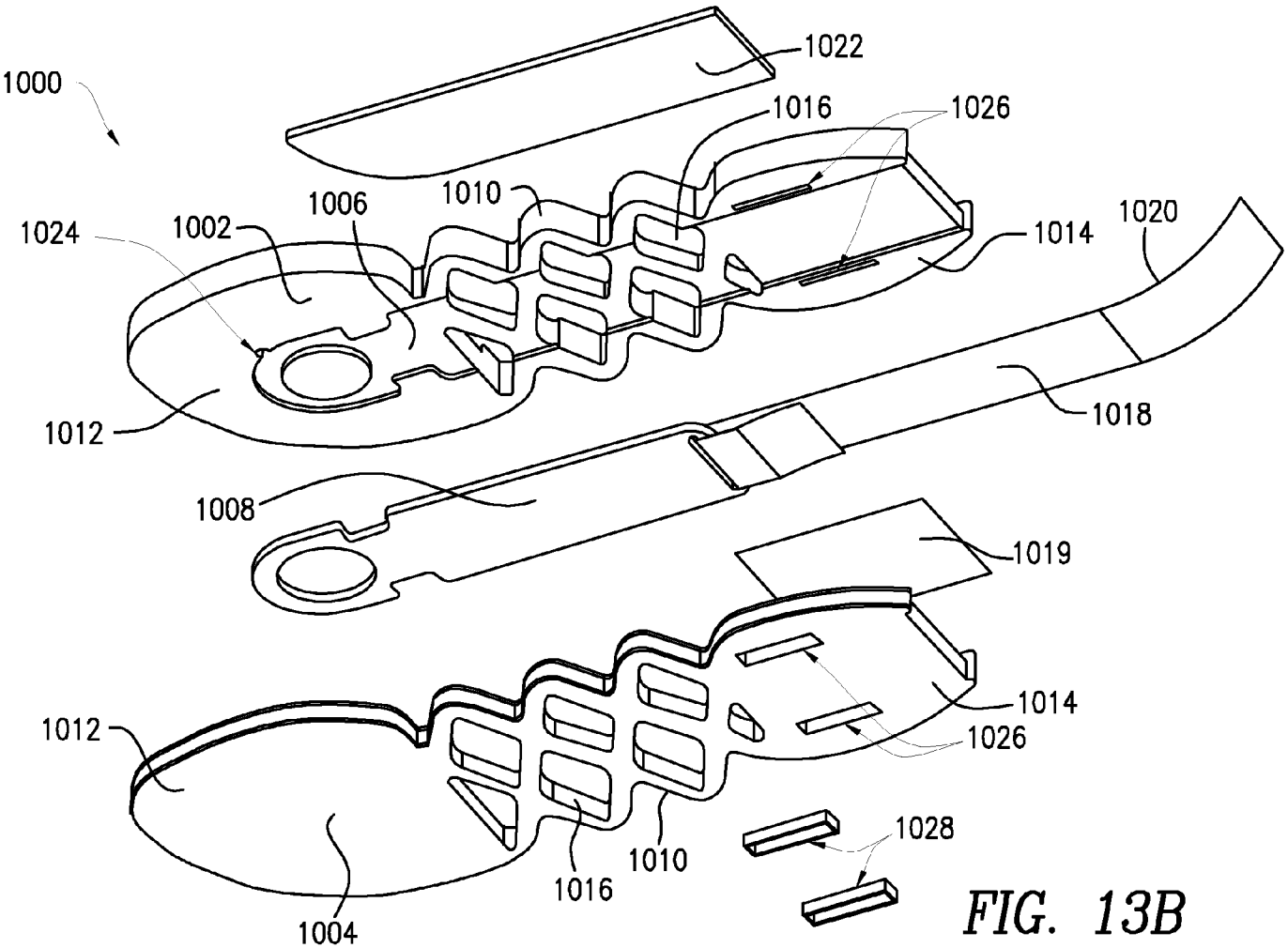

Turning now specifically to FIGS. 13A and 13B, these show an implementation of personally adjustable footwear 1000, constructed and operative according to the teachings of the present invention. Footwear 1000 has a sole arrangement assembled primarily from an upper sole layer 1002 and a lower sole layer 1004, and which form between them a channel 1006 (FIG. 13B) which receives a tongue 1008. At least one, and preferably both, of upper and lower sole layers 1002 and 1004 is formed with a toe portion 1012 and a heel portion 1014 interconnected by an intermediate portion 1010 which features a pattern of vertical openings 1016.

Openings 1016 are preferably deployed to provide a latticework pattern as viewed from above, i.e., a pattern of crisscross strips with roughly parallelogram openings between them, thereby imbuing the intermediate portion with greatly enhanced facility to accommodate longitudinal extension and/or compression while keeping the dimensions of the individual openings relatively small so that the upper surface of upper layer 1002 provides comfortable near-continuous support for the foot of a user. The term "foot support" in this context is used to refer to an element or surface which provides the primary mechanical support to the underside of the foot, but need not be in direct contact with the foot. Thus, the "foot support" may be overlaid by one or more layers of padding or other functional or aesthetic layers. In order to provide the aforementioned near-continuous support for the foot, the plurality of openings are preferably configured to have a maximum open longitudinal dimension no greater than about 2.5 centimeters.

It should be noted that the use of substantially vertical openings to provide the required flexibility has profound advantages over the various solutions proposed by the aforementioned prior art documents. Firstly, since each layer is integrally formed, the production processes required are simple and cost effective, thereby rendering the footwear suitable for large scale production. Secondly, since flexing occurs primarily within the plane of the sole layer, the thickness of the layer remains substantially unchanged during elongation or shortening of the footwear, thereby allowing the upper surface of the upper sole layer to be used directly as a foot support surface without requiring complicated arrangements of overlapping and sliding rigid insoles or the like.

It should be noted that the subdivision of the sole layers into toe portion, heel portion and intermediate portion does not imply any particular relative dimensions between the portions, and that there is no lower limit to the size of the toe portion and heel portion. Thus, one or both of the toe portion and heel portion may optionally be implemented as end portions of the sole layers so that the adjustable-length intermediate layer with its vertical openings occupies a major portion, or even substantially the entirety, of the length of the sole.

As mentioned, the entirety of each layer 1002 and 1004 is preferably formed integrally from material of substantially uniform composition, the varying mechanical properties being provided by the geometrical form of the layer. The separate layers, on the other hand, may be produced from different materials to provide particular desired footwear characteristics. Thus, by way of non-limiting example, upper sole layer 1002 may be formed of relatively soft resilient material to increase wearing comfort while lower sole layer 1004 may be formed of relatively harder abrasion resistant material offering a hard-wearing ground-engaging surface. Suitable materials for providing the required mechanical properties, and suitable associated manufacturing techniques, are well known in the art and will not be addressed here in detail.

As mentioned above, lower sole layer 1002 and upper sole layer 1004 are shaped to define therebetween at least one longitudinal channel 1006 extending longitudinally between toe portions 1012 and heel portions 1014. Tongue 1008, which is deployed within channel 1006, is anchored to either the toe portions 1012 or the heel portions 1014 and is displaceable relative to the other. In the case shown here, tongue 1008 is anchored to toe portions 1012 by a shaped head portion with a central hole which engages a corresponding socket and projecting tab formed in the underside of upper sole layer 1012.

The implementation of FIGS. 13A and 13B is preferably formed with intermediate portion 1010 resiliently biased to separate the toe portion and the heel portion to a predefined relative position corresponding to a maximum length of the sole arrangement. This simplifies the mechanical requirements on the retention mechanism which then needs only act to limit the length of the footwear to a desired length against the inherent elasticity of the sole arrangement. In this case, the retention mechanism further includes a flexible strap 1018 associated with tongue 1008 and extending from the sole arrangement such that tension applied to the flexible strap relative to heel portion 1014 draws together toe portion 1012 and heel portion 1014, thereby shortening a length of the sole arrangement. A low friction slide strip 1019 is optionally provided to help ensure free longitudinal movement of the strap 1018 at its relative thick point of attachment to tongue 1008. A locking arrangement is also provided for locking the flexible strap in a plurality of positions, thereby retaining the sole arrangement at a desired length.

In the particularly preferred implementation illustrated here, the locking arrangement includes a first part of a hook-and-loop fastener 1020, such as the fastener type typically referred to by the name Velcro™, associated with an end portion of flexible strap 1018 and a complementary part of a hook-and-loop fastener 1022 associated with an upward-facing surface of the sole arrangement such that the flexible strap is folded onto the upward-facing surface to lock the sole arrangement at a desired length. Although the hook-and-loop fastener is a particularly preferred option due to its convenience and continuous adjustability, it should be noted that alternative fasteners are also within the scope of the invention. Examples include, but are not limited to, snap-in-studs, various plug-and-socket arrangements, and various types of pins or hooks. In all cases, the fastener is preferably chosen to be a manually operated fastener which does not require any tools or any difficult manipulation to perform.

For simplicity of presentation, the implementation shown here is a sandal of the "thong" type, having an aperture 1024, slits 1026 and clips 1028 for retaining the straps in the required positions. As before, the principles of the present invention are equally applicable to all types of footwear, as will be clear to one ordinarily skilled in the art.

Figure 13C:
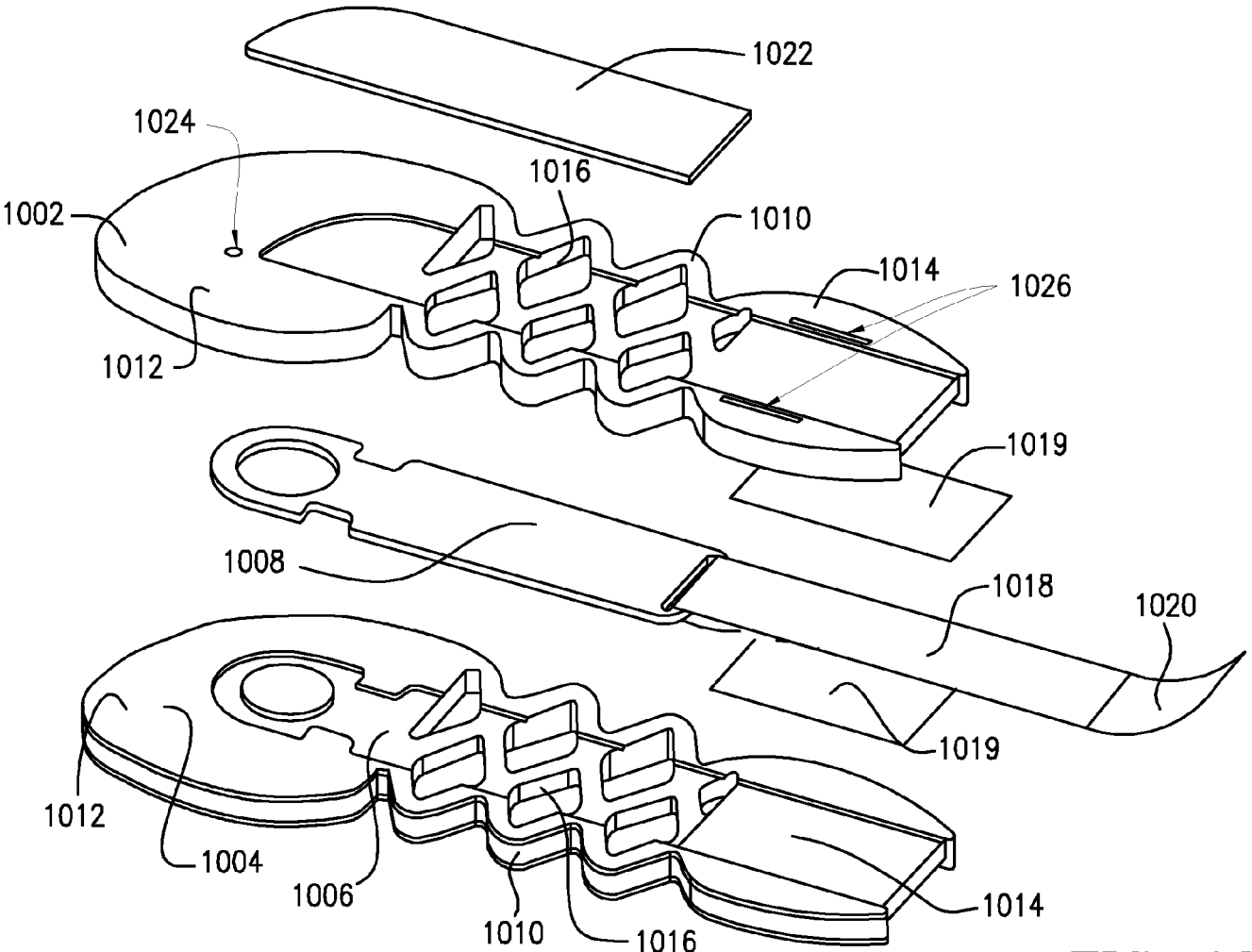
FIGS. 13C and 13D are upper and lower exploded isometric views of a slight variant of the implementation of FIGS. 13A and 13B.
Figure 13D:
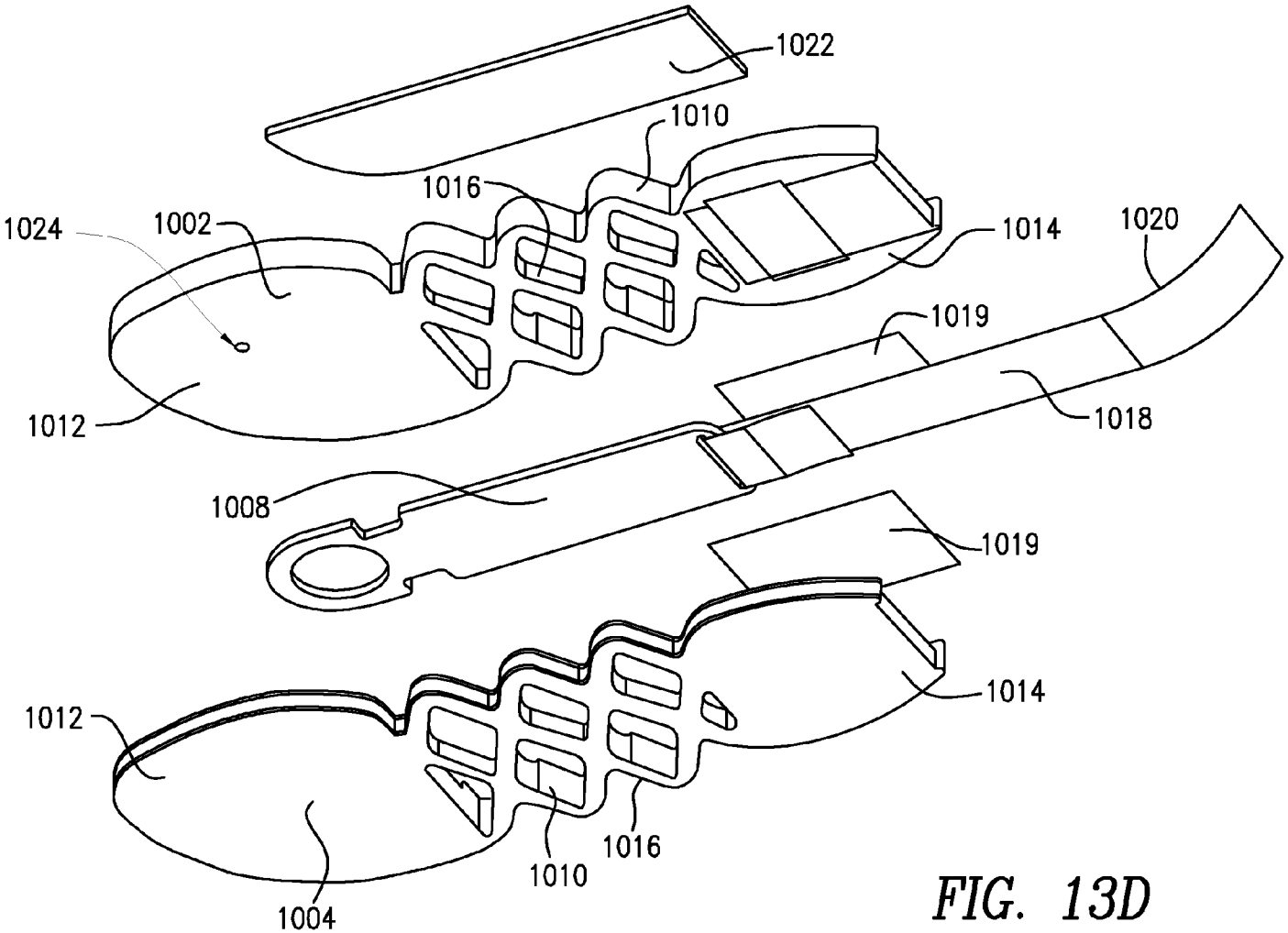

Turning now briefly to FIGS. 13C and 13D, these show an implementation closely analogous to that of FIGS. 13A and 13B, differing primarily in that channel 1006 and the socket and tab for accommodating tongue 1008 are formed primarily in the upper surface of lower sole layer 1004. In all other respects, the implementation of FIGS. 13C and 13D may be fully understood with reference to the description of FIGS. 13A and 13B. It should further be noted that other configurations, including but not limited to, implementations where the sole arrangement is formed form a single unitary layer with a suitable channel formed therethrough, or where the channel passes along the upper or lower surface of the sole arrangement, also fall within the scope of the present invention.

Figure 18:
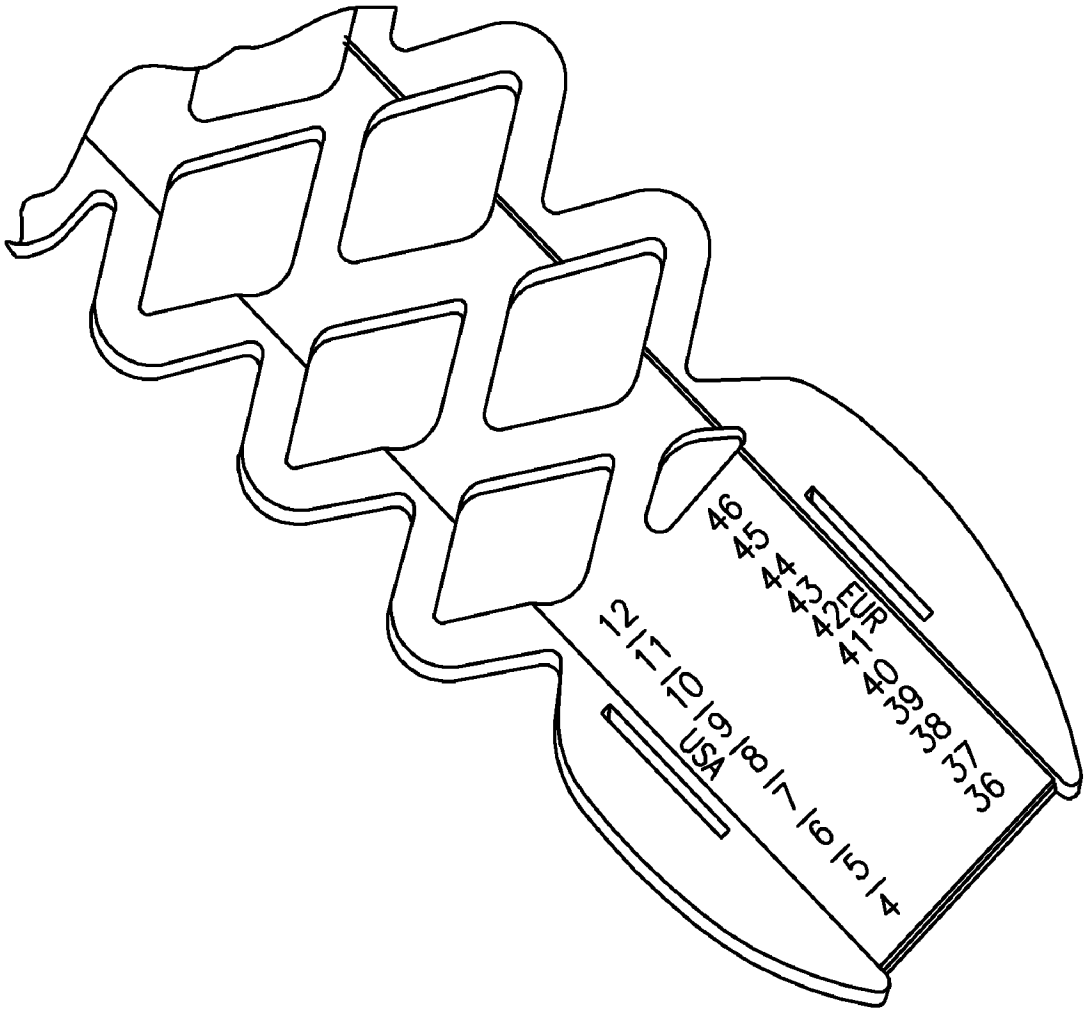
FIG. 18 is an isometric view of deployment of a set of size indicating indices for use in the above-referenced implementations according to a further feature of the present invention.

Referring briefly to FIG. 18, it should be noted that implementations of the present invention employing straps folded onto the surface of the sole arrangement may also be provided with arrangements of indices indicating the corresponding shoe size to which the footwear is adjusted. In this case, the indices preferably appear on an upward facing surface of the sole arrangement and are aligned with a corresponding mark, tab or cut-out window formed in the flexible strap 1018.

Figure 14B:
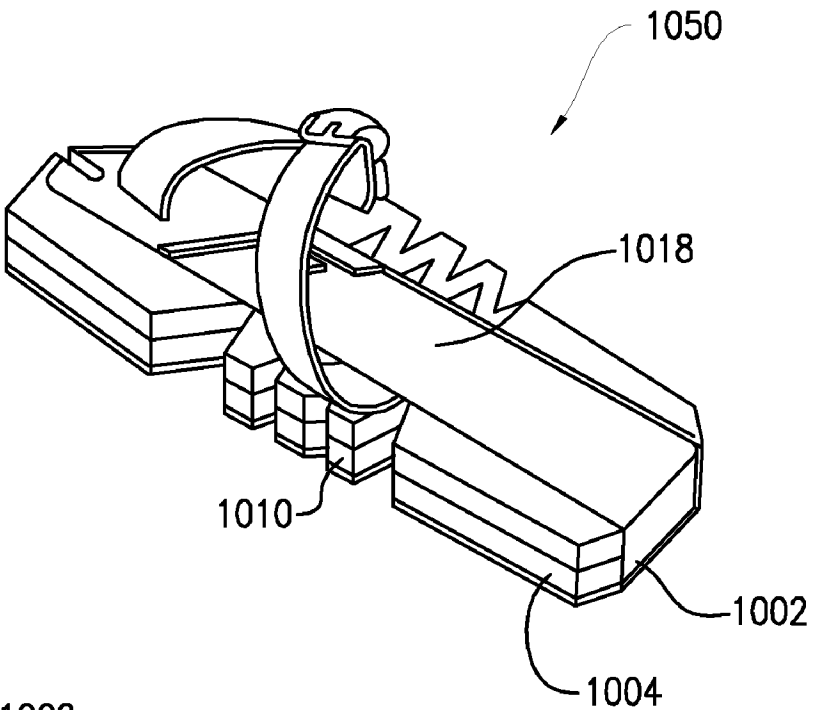
FIGS. 14A and 14B are isometric views of a second variant of the embodiment of FIGS. 6 and 7, shown in an elongated and shortened state, respectively.
Figure 14A:
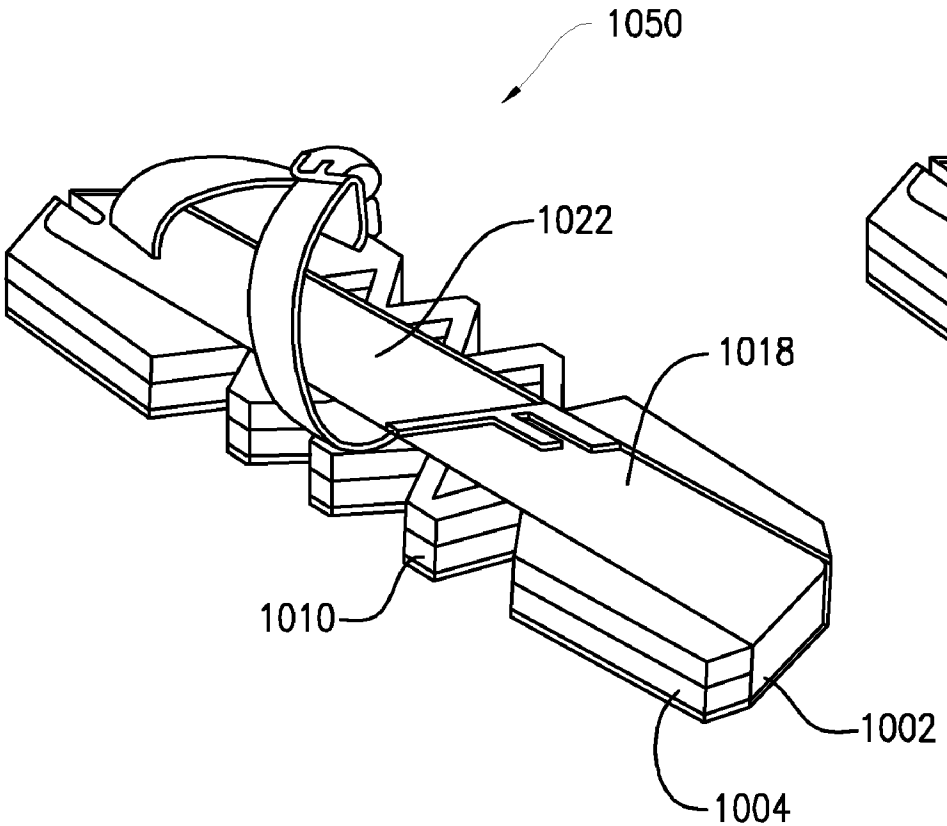
Figure 14C:
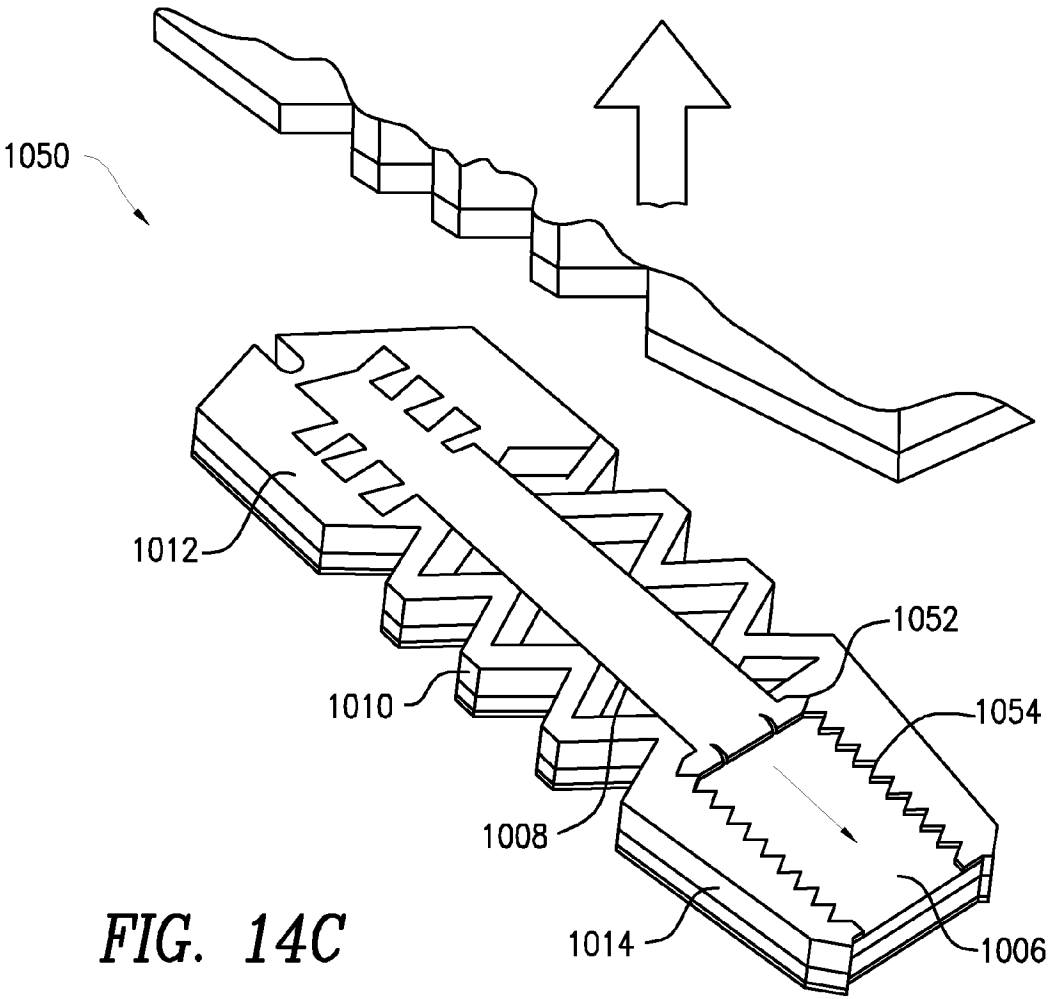
FIG. 14C is a partial exploded view of the implementation of FIG. 14A.

Turning now to FIGS. 14A-14C, these show a further implementation of footwear, generally designated 1050, constructed and operative according to the teachings of the present invention. Footwear 1050 is generally similar to footwear 1000, and equivalent elements are labeled similarly. Footwear 1050 differs from footwear 1000 primarily by the inclusion of an additional stepped resistance arrangement.

Specifically, the retention mechanism of footwear 1050 includes a stepped resistance arrangement, associated with tongue 1008 and heel portion 1014, configured to provide a resistive force opposing relative displacement of the toe portion and the heel portion between a plurality of predefined relative positions corresponding to a plurality of different lengths of the sole arrangement. As a result, a length of the sole arrangement is manually adjustable by manual application of force to overcome the resistive force, while in the absence of manually applied force, the toe portion and the heel portion are retained in one of the predefined relative positions. In other words, when flexible strap 1018 is not fastened, the sole arrangement can be taken in two hands by a user and the toe and heel either pulled apart or pushed together, passing through a plurality of states each defined by a positive "click" position. Then, when the desired length of the footwear is achieved, flexible strap 1018 is fastened as described above to provide supplemental fixing of the desired length.

One preferred example of an implementation of the stepped resistance arrangement is visible in the partial exploded view of FIG. 14C. In this case, tongue 1008 is formed with a pair of resilient outwardly-biased tabs 1052 which engage a sequence of V-shaped notches 1054 formed along sides of channel 1006 within heel portion 1014. The resilience of tabs 1052 and the angle of notches 1054 are chosen to ensure that the sole arrangement can be manually and non-destructively adjusted by application of axial compression or tension while providing sufficient resistive forces to retain a current length in the absence of significant externally applied forces.

The combination of the stepped resistance arrangement together with the flexible strap fastening arrangement is considered particularly advantageous since it combined the convenience of temporary fixing of the length prior to attachment of the strap fastening with the positive fastening effect of the strap arrangement. Nevertheless, it should be appreciated that both the strap fastening arrangement and the stepped resistance arrangement are each considered to be individually useful as freestanding products in their own right.

Figure 15B:
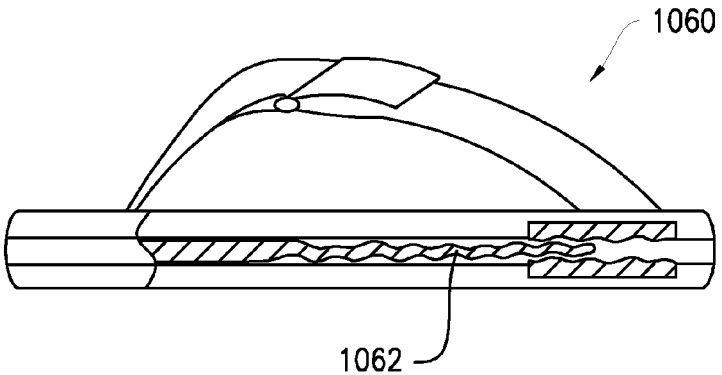
FIG. 15B is a longitudinal cross-sectional view taken through the implementation of FIG. 15A.
Figure 15A:
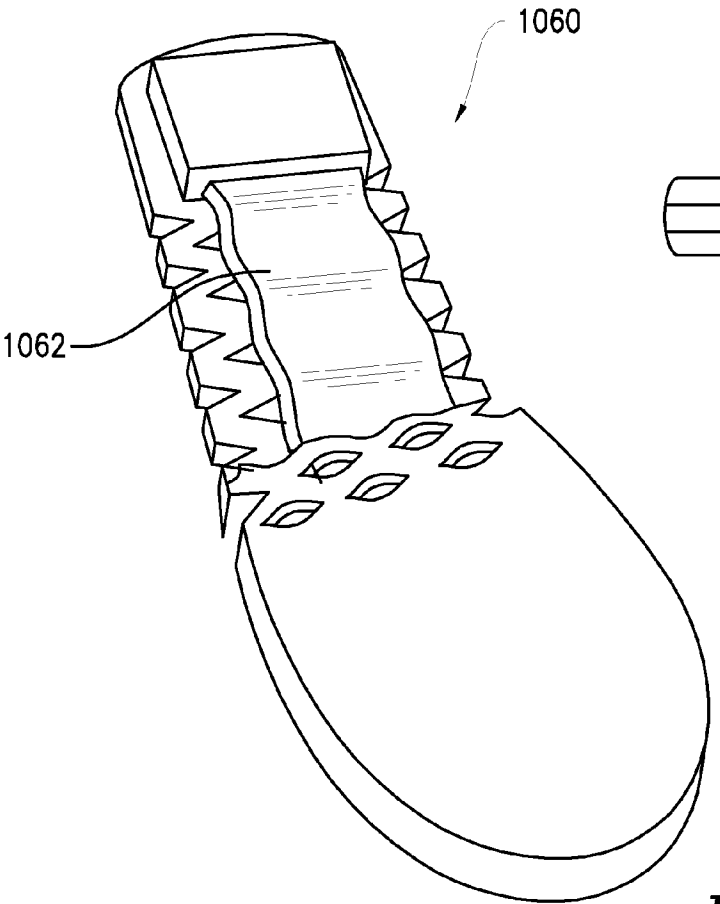
FIG. 15A is a partially cut-away lower isometric view of a third variant of the embodiment of FIGS. 6 and 7.

Turning now to FIGS. 15A and 15B, it should be noted that many other arrangements may be used to implement the aforementioned stepped resistance arrangement. By way of a further non-limiting example, FIGS. 15A and 15B illustrate a stepped resistance arrangement wherein the lateral engagement of the previous implementation is replaced with a vertically undulating arrangement. Specifically, this implementation of an item of footwear 1060 employs a tongue 1008 having a vertically undulating tail portion 1062 which passes over and/or under corresponding undulating configurations formed in the overlying surface of the upper sole layer and/or upper surface of the lower sole layer. This arrangement provides a similar stepped resistance effect to the notched arrangement described above.

Figure 16B:
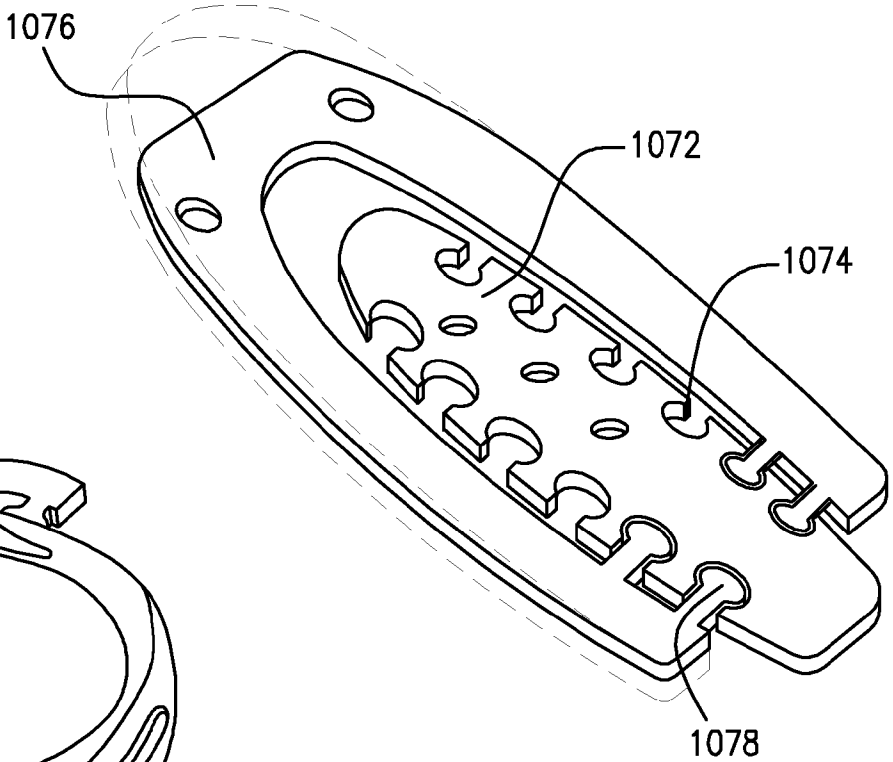
FIG. 16B is an isometric view of a retention mechanism from the implementation of FIG. 16A.
Figure 16A:
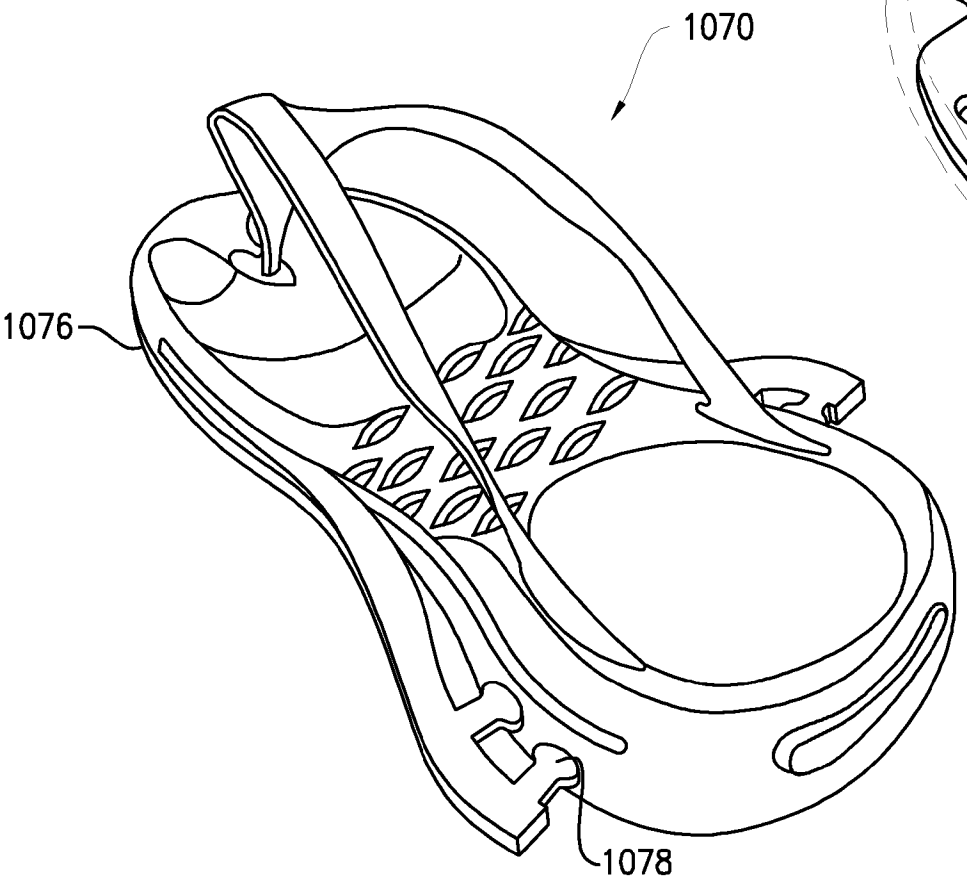
FIG. 16A is an isometric view of a fourth variant of the embodiment of FIGS. 6 and 7.

Turning now to FIGS. 16A and 16B, there is shown a further variation of footwear, generally designated 1070, constructed and operative according to the teachings of the present invention, in which the retention mechanism includes a manually releasable and manually engagable locking mechanism for locking a relative position of the toe portion and the heel portion. In this case, a central tongue 1072 incorporated in the heel portion is formed with a bilateral series of recesses 1074 and a complementary fork 1076 incorporated in the toe portion is formed with outwardly flexible arms which bear engagement features 1078 for engaging the recesses. This arrangement provides manually operated positive locking of the length of the sole arrangement. This allows the use of an intermediate portion of the sole arrangement which is biased to either an intermediate length state or even the shortest length state, the sole arrangement being locked in a state with a desired degree of longitudinal extension (stretching) by the retention mechanism.

Figure 17B:
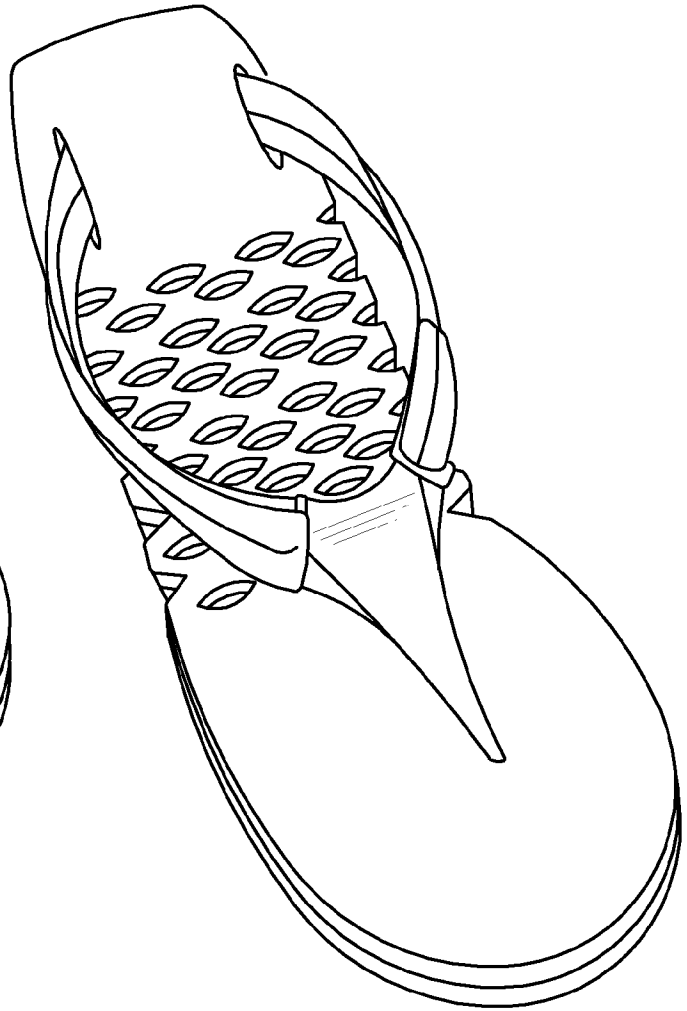
FIGS. 17A and 17B are isometric views illustrating a further optional form of openings for rendering an intermediate sole portion flexible for implementation of the present invention.
Figure 17A:
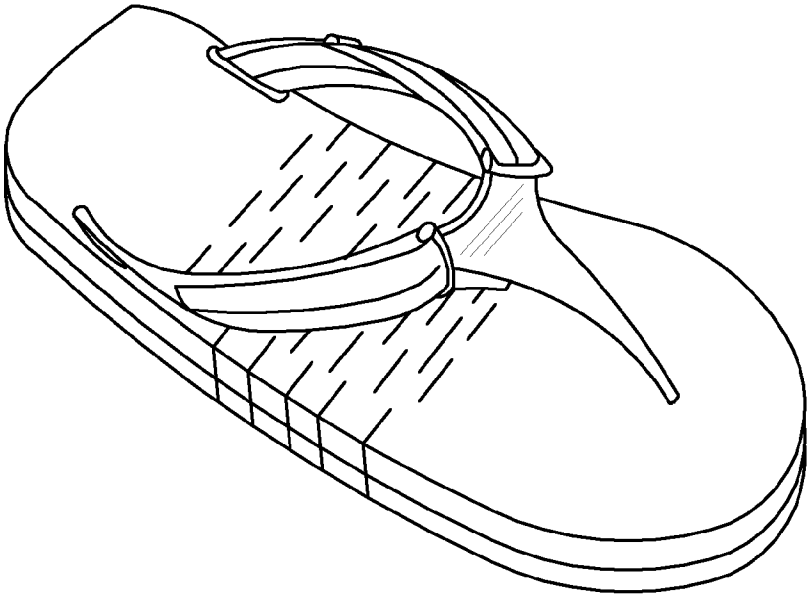

Referring briefly to FIGS. 17A and 17B, there is shown one example of an arrangement of vertical openings for the intermediate portion of the sole arrangement particularly suitable for implementations which are initially biased to their shortest state. Specifically, in this case, the sole arrangement is formed from one or more layers which initially assumes an unstressed state having a series of staggered transverse slits in its intermediate portion (FIG. 17A). When stretched longitudinally, the material of the intermediate portion opens up to form a latticework pattern as illustrated in FIG. 17B.

Figure 8:
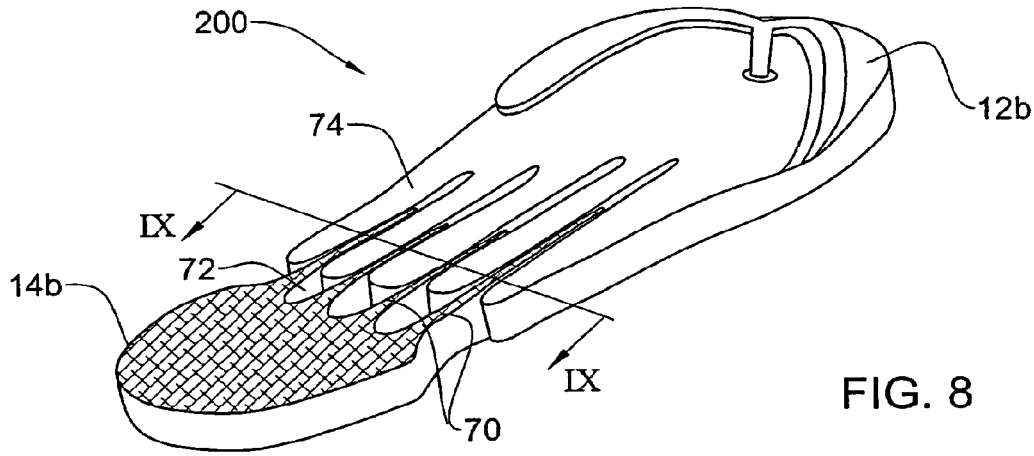
FIG. 8 is a top perspective view of a further embodiment of the present invention.
Figure 9A:
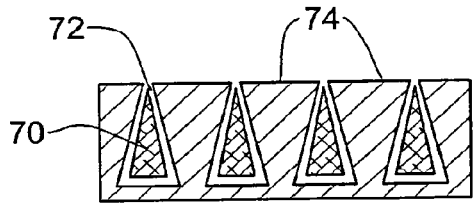
FIG. 9A is a sectional view taken through plane IX-IX of FIG. 8.
Figure 9B:
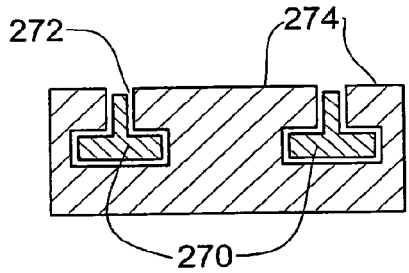
FIG. 9B is a sectional view analogous to that of FIG. 9A illustrating an exemplary modification of the embodiment shown in FIG. 8.
Figure 10:
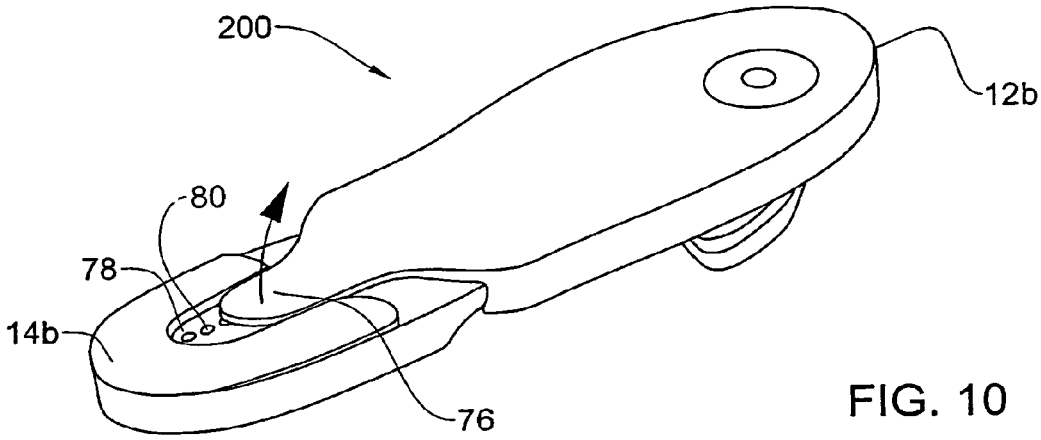
FIG. 10 is a bottom perspective view of the embodiment shown in FIG. 8.

According to a further embodiment of the present invention, illustrated in FIGS. 8-10, there is an article of footwear 200 comprising elongated projections 70 extending from a heel 14*b* toward a toe 12*b* thereof. The profile of the projections 70 (FIG. 9A) corresponds to channels 72 in an elongated projection receiving portion 74 projecting from the toe 12*b*.

The heel's projections 70 are slidable toward and apart from the receiving portion 74. It should be noted however that the profile of the projections 70, in combination with the shape of the receiving portions channels 72, are of a geometry whereby the members are prevented from significantly sliding with respect to each other in the vertical direction. This is a much preferred situation for since it would otherwise be potentially inconvenient or uncomfortable to the wearer. It should be understood that many other profile/shape combinations are possible which would prevent such unwanted vertical displacement.

FIG. 9B illustrates one example of the many alternative interacting configurations for elongated projections and corresponding channels of a projection receiving portion. In this example, the projections are inverted T-shaped elongated projections 270, which are engagable in correspondingly shaped channels 272 with a projection receiving portion 274. It should be understood that such projections may be any of a variety of profiles in addition to those described above, e.g. L-shaped, bulb-shaped, J-shaped, Y-shaped, anchor-shaped, cross-shaped, and the like.

Appropriate design of the exemplary projections 70, 270 and channels 72, 272, respectively, can allow the footwear 200 to be adjusted to a desired length and remain at such while it is worn, for example, via a pressure or friction inter-fitting of the projections and receiving portions. However, the footwear 200 typically will include an auxiliary locking arrangement, such as that now described.

An example of such a locking arrangement is shown in FIG. 10, wherein extending from the toe 12*b* toward the heel 14*b* is a tongue 76 which comprises at least one peg-like member projecting therefrom. The peg-like member is not visible, however it can be of a form similar to that described above with reference to FIGS. 6 and 7. The heel 14*b* comprises a tongue receptacle 78 comprising a plurality of depressions 80 which are adapted to receive the at least one peg-like member.

The size of the shoe can be adjusted by removing the tongue 76 from the tongue receptacle 78, sliding the toe and the heel apart or together—corresponding to the desired footwear size—and then reengaging the tongue 76 and the tongue receptacle 78 (i.e. pressing the peg-like structure into a/the depression(s)).

Once again, it should be understood that heel/toe (i.e. projections/receiving portion) could be arranged conversely and that the tongue could be disposed at either of the top or bottom of the sole of the footwear and could alternatively extend from the heel 14*b*, mutatis mutandis.

Figure 11:
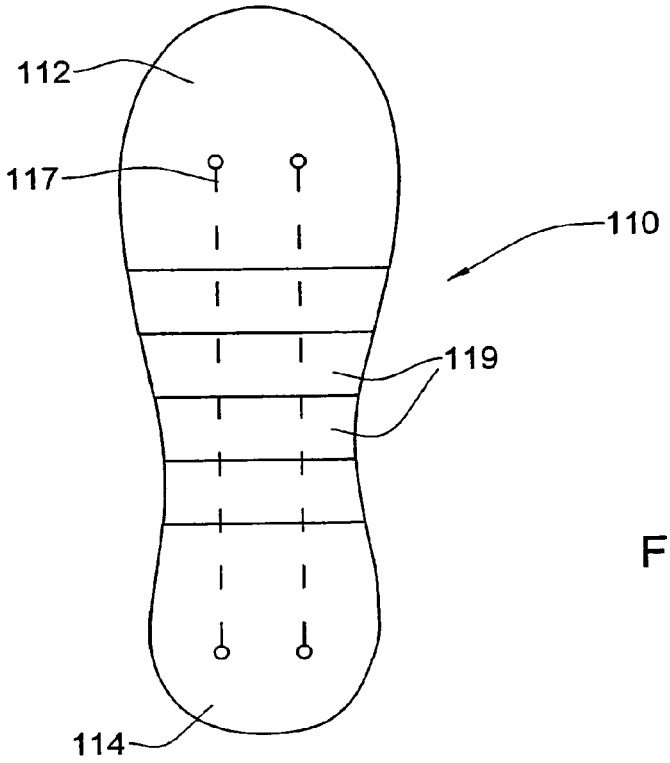
FIG. 11 is a bottom view of a modification of the embodiment of FIG. 1.

FIG. 11 shows a modification of the embodiment of FIG. 1 where there is footwear 110 wherein extending between a toe 112 and a heel 114 is at least one, typically more than one, segment holding member in the form of a stretchable member or elastic member 117 (two shown) running through segments 119 (therefore shown by dashed lines). The segments 119 can be added or removed upon pulling the toe 112 and heel 114 apart and the segment(s) is then fitted on the elastic member 117 or removed therefrom, respectively.

Figure 12A:
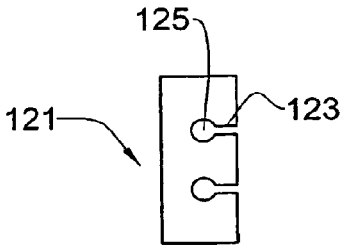
FIG. 12A-12C are side views of exemplary segments for use in the embodiment of FIG. 11.
Figure 12B:
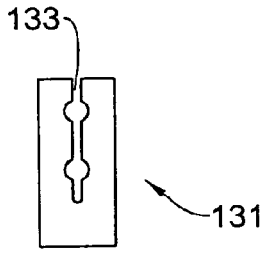
Figure 12C:
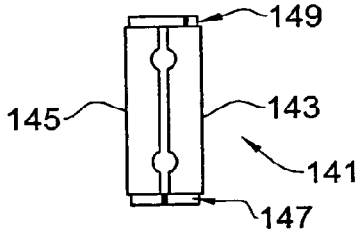

FIGS. 12A-12C provide some examples of segments which are suitable for use in the embodiment of FIG. 11. As such, FIG. 12A shows a segment 121 with one or more slits 123 adapted to allow the elastic member 117 to slide therealong the slits having a cavity 125 for holding the elastic member when the footwear 110 is assembled.

FIG. 12B shows a segment 131 having a transverse slit 133, the segment adapted to spread open whereby the elastic member 117 can be inserted or removed for adding or removing a segment, respectively.

FIG. 12C shows a segment 141 comprising two portions 143 and 145 held adjacent to each other by a hinge 147 at one end thereof and having a latch arrangement 149 at the other end thereof. To allow adding the segment 141 to the footwear 110, the segment can be opened by unlatching the latch arrangement 149 and pivoting the portions 143, 145 at the hinge 147 and fitting the segment around the elastic member 117. The reverse procedure is used to remove the segment 141 from the footwear 110.

It should be understood that segments such as segments 121, 131 and 141, and the like, can also be used in connection with the embodiment of FIG. 1.

It will be appreciated by persons skilled in the art that the present invention is not limited by what has been particularly shown by the exemplary embodiments described hereinabove. Thus, it should be understood that numerous additional embodiments are within the scope of the invention, mutatis mutandis.

For example, regarding the embodiment described with reference to FIGS. 1-5, the segments 16 and 16*b* need not be juxtaposed in an aligned manner and, for example, may be arranged in a fashion where they are staggered, angled, etc. thereby providing the wearer with different fashion options or individual expression. In this regard, it should be understood that the segments 16, 16*a* and 16*b* could be of a variety of shapes and colors and may comprise various ornamental features. Further, the bores 20 could be angled with respect to the heel/toe to facilitate assembly options for the footwear 10. Additionally, the segments 16, 16*a* and 16*b* could comprise a texture, for example, to provide a massaging effect to the wearer, for aesthetic purposes, for a combination of these, or for other purposes.

Further, the invention has been illustrated in relation to sandal type (i.e. so-called flip-flops or thongs), however, the invention also can embody footwear such as more conventional shoes and the like by incorporating known means for allowing the expansion/contraction of a footwear's upper portion (e.g. that described in the above-mentioned prior art).

In addition, it should be understood that features of the above embodiments may be combined or substituted for other features. For example, in connection to the embodiments described with reference to FIGS. 1-5, the segments 16, 16*a* and 16*b* may be held on a segment holding member being a tongue-like member, in place of the rods 18; and, those embodiments may incorporate locking mechanisms such as described with reference to FIGS. 6 and 10.

It will be appreciated that the above descriptions are intended only to serve as examples, and that many other embodiments are possible within the scope of the present invention as defined in the appended claims.

What is claimed is:

1. A personally adjustable sandal comprising:(a) a sole comprising at least one sole layer, said sole having an upper surface and a bottom surface, and including a toe portion, a heel portion, and an intermediate portion, said intermediate portion being integrally formed with both said toe portion and said heel portion, said intermediate portion having a plurality of openings passing substantially vertically through said sole, from and including through said upper surface and said bottom surface, so that said intermediate portion is elastically flexible to allow relative longitudinal displacement of said toe portion and said heel portion to vary a length of said sole without significant variation in a thickness of said sole by compressing or elongating the vertical openings through the sole; and(b) a retention mechanism associated with both said toe portion and said heel portion, said retention mechanism being configured for retaining any of a plurality of relative positions between said toe portion and said heel portion.

2. The personally adjustable sandal of claim 1, wherein said toe portion, said heel portion and said intermediate portion are all integrally formed from a uniform composition.

3. The personally adjustable sandal of claim 1, wherein said plurality of openings are deployed to provide a latticework pattern as viewed from above.

4. The personally adjustable sandal of claim 1, wherein said upper surface of said sole provides a foot support, wherein said plurality or openings are configured to have a maximum open longitudinal dimension no greater than about 2.5 centimeters so as to provide near-continuous foot support.

5. The personally adjustable sandal of claim 1, wherein said sole comprises at least two sole layers including a lower sole layer having a bottom surface configured for ground engagement and an upper sole layer including an upper surface for supporting a foot.

6. The personally adjustable sandal of claim 5, wherein said upper sole layer is formed from a material softer than said lower sole layer.

7. The personally adjustable sandal of claim 5, wherein said lower sole layer and said upper sole layer are shaped to define therebetween at least one channel formed between said upper surface and said bottom surface of said sole extending longitudinally between said toe portions and said heel portions, and wherein said retention mechanism includes an element deployed within said channel, said element being anchored to a first of said toe portion and said heel portion and being displaceable relative to the second of said toe portion and said heel portion.

8. The personally adjustable sandal of claim 7, wherein said retention mechanism further includes a stepped resistance arrangement associated with said element and said second of said toe portion and said heel portion, said stepped resistance arrangement providing a resistive force opposing relative displacement of said toe portion and said heel portion between a plurality of predefined relative positions corresponding to a plurality of different lengths of said sole, such that a length of said sole is manually adjustable by manual application of force to overcome said resistive force, and such that, in the absence of manually applied force, said toe portion and said heel portion are retained in one of said predefined relative positions.

9. The personally adjustable sandal of claim 8, wherein said intermediate portion is resiliently biased to separate said toe portion and said heel portion to a predefined relative position corresponding to a maximum length of said sole, and wherein said retention mechanism further includes:(a) a flexible strap associated with said element and extending from said sole such that tension applied to said flexible strap relative to said second of said toe and said heel portions draws together said toe portion and said heel portion, thereby shortening said length of said sole; and(b) a locking arrangement for locking said flexible strap in a plurality of positions, thereby retaining said sole at a desired length.

10. The personally adjustable sandal of claim 7, wherein said intermediate portion is resiliently biased to separate said toe portion and said heel portion to a predefined relative position corresponding to a maximum length of said sole, and wherein said retention mechanism further includes:(a) a flexible strap associated with said element and extending from said sole such that tension applied to said flexible strap relative to said second of said toe and said heel portions draws together said toe portion and said heel portion, thereby shortening a length of said sole arrangement; and(b) a locking arrangement for locking said flexible strap in a plurality of positions, thereby retaining said sole arrangement at a desired length.

11. The personally adjustable sandal of claim 10, wherein said locking arrangement includes a first part of a hook-and-loop fastener associated with an end portion of said flexible strap and a complementary part of a hook-and-loop fastener associated with an upward-facing surface of said sole such that said flexible strap is folded onto said upward-facing surface to lock said sole at a desired length.

12. The personally adjustable sandal of claim 7, wherein said retention mechanism further includes a manually releasable and manually engagable locking mechanism for locking a position of said element relative to said second of said toe portion and said heel portion.

13. The personally adjustable sandal of claim 1, wherein said retention mechanism includes a manually releasable and manually engagable locking mechanism for locking a relative position of said toe portion and said heel portion.

14. The personally adjustable sandal of claim 1, wherein the sole further comprises at least one channel formed between said upper surface and said bottom surface of said sole, extending longitudinally between said toe portions and said heel portions, and wherein said retention mechanism includes an element deployed within said channel, said element being anchored to a first of said toe portion and said heel portion and being displaceable relative to the second of said toe portion and said heel portion.

15. The personally adjustable sandal of claim 14, wherein said retention mechanism further includes a stepped resistance arrangement associated with said element and said second of said toe portion and said heel portion, said stepped resistance arrangement providing a resistive force opposing relative displacement of said toe portion and said heel portion between a plurality of predefined relative positions corresponding to a plurality of different lengths of said sole arrangement, such that a length of said sole is manually adjustable by manual application of force to overcome said resistive force, and such that, in the absence of manually applied force, said toe portion and said heel portion are retained in one of said predefined relative positions.

16. The personally adjustable sandal of claim 14, wherein said retention mechanism further includes a manually releasable and manually engagable locking mechanism for locking a position of said element relative to said second of said toe portion and said heel portion.

17. A personally adjustable sandal comprising:(a) a sole having an upper surface and a bottom surface, and including a toe portion, a heel portion, and an intermediate portion, said intermediate portion being integrally formed with both said toe portion and said heel portion, said intermediate portion having a plurality of openings passing substantially vertically through said sole, from and including trough said upper surface and said bottom surface, so that said intermediate portion is elastically flexible to allow relative longitudinal displacement of said toe portion and said heel portion to vary a length of said sole without significant variation in a thickness of said sole by compressing or elongating the vertical openings through the sole, wherein said sole comprises at least two sole layers including a lower sole layer having said bottom surface configured for ground engagement and an upper sole layer including said upper surface for supporting a foot, said lower sole layer and said upper sole layer shaped to define therebetween at least one channel formed between said upper surface and said bottom surface of said sole, extending longitudinally between said toe portion and said heel portion; and(b) a retention mechanism associated with both said toe portion and said heel portion, said retention mechanism being configured for retaining any of a plurality of relative positions between said toe portion and said heel portion, wherein said retention mechanism includes an element deployed within said channel, said element being anchored to a first of said toe portion and said heel portion and being displaceable relative to the second of said toe portion and said heel portion.

18. The footwear of claim 17, wherein said retention mechanism further includes a stepped resistance arrangement associated with said element and said second of said toe portion and said heel portion, said stepped resistance arrangement providing a resistive force opposing relative displacement of said toe portion and said heel portion between a plurality of predefined relative positions corresponding to a plurality of different lengths of said sole, such that a length of said sole is manually adjustable by manual application of force to overcome said resistive force, and such that, in the absence of manually applied force, said toe portion and said heel portion are retained in one of said predefined relative positions.

19. The personally adjustable sandal of claim 17, wherein said retention mechanism further includes a manually releasable and manually engagable locking mechanism for locking a position of said element relative to said second of said toe portion and said heel portion.

20. A personally adjustable sandal comprising:(a) a sole having an upper surface and a bottom surface, and including a toe portion, a heel portion, and an intermediate portion, said intermediate portion being integrally formed with both said toe portion and said heel portion, said intermediate portion having a plurality of openings passing substantially vertically through said sole, from and including trough said upper surface and said bottom surface, so that said intermediate portion is elastically flexible to allow relative longitudinal displacement of said toe portion and said heel portion to vary a length of said sole without significant variation in a thickness of said sole by compressing or elongating the vertical openings through the sole, wherein said sole comprises at least two sole layers including a lower sole layer having said bottom surface configured for ground engagement and an upper sole layer including said upper surface for supporting a foot, said lower sole layer and said upper sole layer shaped to define therebetween at least one channel formed between said upper surface and said bottom surface of said sole, extending longitudinally between said toe portion and said heel portion; and(b) a retention mechanism associated with both said toe portion and said heel portion, said retention mechanism being configured for retaining any of a plurality of relative positions between said toe portion and said heel portion, wherein said retention mechanism includes an element deployed within said channel, said element being anchored to a first of said toe portion and said heel portion and being displaceable relative to the second of said toe portion and said heel portion, and further includes a stepped resistance arrangement associated with said element and said second of said toe portion and said heel portion, said stepped resistance arrangement providing a resistive force opposing relative displacement of said toe portion and said heel portion between a plurality of predefined relative positions corresponding to a plurality of different lengths of said sole, such that a length of said sole is manually adjustable by manual application of force to overcome said resistive force, and such that, in the absence of manually applied force, said toe portion and said heel portion are retained in one of said predefined relative positions, and a manually releasable and manually engagable locking mechanism for locking a position of said element relative to said second of said toe portion and said heel portion.

* * * * *